US009542927B2

(12) United States Patent
Agiomyrgiannakis et al.

(10) Patent No.: US 9,542,927 B2
(45) Date of Patent: Jan. 10, 2017

(54) METHOD AND SYSTEM FOR BUILDING TEXT-TO-SPEECH VOICE FROM DIVERSE RECORDINGS

(71) Applicant: Google Inc., Mountain View, CA (US)

(72) Inventors: Ioannis Agiomyrgiannakis, London (GB); Alexander Gutkin, London (GB)

(73) Assignee: Google Inc., Mountain View, CA (US)

( * ) Notice: Subject to any disclaimer, the term of this patent is extended or adjusted under 35 U.S.C. 154(b) by 140 days.

(21) Appl. No.: 14/540,088

(22) Filed: Nov. 13, 2014

(65) Prior Publication Data

US 2016/0140951 A1 May 19, 2016

(51) Int. Cl.

| | |
|---|---|
| ***G10L 13/08*** | (2013.01) |
| ***G10L 13/02*** | (2013.01) |
| *G10L 13/06* | (2013.01) |
| *G10L 25/03* | (2013.01) |

(52) U.S. Cl.
CPC ..... *G10L 13/02* (2013.01); *G10L 13/06* (2013.01); *G10L 25/03* (2013.01)

(58) Field of Classification Search
CPC ..... G10L 13/00; G10L 15/26; G06F 17/289; G06F 17/2854
USPC ..... 704/2, 260
See application file for complete search history.

(56) References Cited

U.S. PATENT DOCUMENTS

| | | | | |
|---|---|---|---|---|
| 5,129,002 | A | 7/1992 | Tsuboka | |
| 5,307,444 | A | 4/1994 | Tsuboka | |
| 5,913,193 | A * | 6/1999 | Huang | G10L 13/07 704/256 |
| 6,125,345 | A | 9/2000 | Modi et al. | |
| 6,212,500 | B1 | 4/2001 | Kohler | |
| 6,460,017 | B1 | 10/2002 | Bub et al. | |
| 7,003,460 | B1 | 2/2006 | Bub et al. | |
| 7,216,077 | B1 | 5/2007 | Padmanabhan et al. | |
| 7,487,091 | B2 | 2/2009 | Miyazaki | |
| 7,565,282 | B2 | 7/2009 | Carus et al. | |

(Continued)

OTHER PUBLICATIONS

Yannis Stylianou and Eric Moulines, "Continuous probabilistic transform for voice conversion," IEEE Transactions on Speech and Audio Processing, vol. 6, pp. 131-142, 1998.

(Continued)

*Primary Examiner* — Jakieda Jackson
(74) *Attorney, Agent, or Firm* — McDonnell Boehnen Hulbert & Berghoff LLP

(57) ABSTRACT

A method and system is disclosed for building a speech database for a text-to-speech (TTS) synthesis system from multiple speakers recorded under diverse conditions. For a plurality of utterances of a reference speaker, a set of reference-speaker vectors may be extracted, and for each of a plurality of utterances of a colloquial speaker, a respective set of colloquial-speaker vectors may be extracted. A matching procedure, carried out under a transform that compensates for speaker differences, may be used to match each colloquial-speaker vector to a reference-speaker vector. The colloquial-speaker vector may be replaced with the matched reference-speaker vector. The matching-and-replacing can be carried out separately for each set of colloquial-speaker vectors. A conditioned set of speaker vectors can then be constructed by aggregating all the replaced speaker vectors. The condition set of speaker vectors can be used to train the TTS system.

33 Claims, 13 Drawing Sheets

(56) References Cited

U.S. PATENT DOCUMENTS

| | | | | |
|---|---|---|---|---|
| 7,603,276 | B2 | 10/2009 | Yoshizawa | |
| 7,881,930 | B2 | 2/2011 | Faisman et al. | |
| 8,136,154 | B2 | 3/2012 | Phoha et al. | |
| 8,301,449 | B2 | 10/2012 | He et al. | |
| 8,620,136 | B1 * | 12/2013 | Malegaonkar | H04N 5/781 386/239 |
| 2004/0078204 | A1 * | 4/2004 | Segond | G09B 5/06 704/277 |
| 2005/0131694 | A1 | 6/2005 | Nishitani et al. | |
| 2005/0203737 | A1 | 9/2005 | Miyazaki | |
| 2005/0216267 | A1 * | 9/2005 | Kustner | G10L 13/08 704/260 |
| 2006/0100874 | A1 | 5/2006 | Oblinger et al. | |
| 2006/0136209 | A1 | 6/2006 | Menendez-Pidal et al. | |
| 2006/0230140 | A1 | 10/2006 | Aoyama et al. | |
| 2008/0059200 | A1 * | 3/2008 | Puli | G06F 17/289 704/277 |
| 2008/0091424 | A1 | 4/2008 | He et al. | |
| 2008/0319743 | A1 | 12/2008 | Faisman et al. | |
| 2010/0198577 | A1 | 8/2010 | Chen et al. | |
| 2011/0307241 | A1 * | 12/2011 | Waibel | G10L 15/265 704/2 |
| 2016/0140114 | A1 * | 5/2016 | Orsini | G06F 17/2854 704/2 |

OTHER PUBLICATIONS

Kuldip K Paliwal and Bishnu S Atal, "Efficient vector quantization of Ipc parameters at 24 bits/frame," Speech and Audio Processing, IEEE Transactions on, vol. 1, No. 1, pp. 3-14, 1993.

W Bastiaan Kleijn and Kuldip K Paliwal, "Principles of Speech Coding," Speech coding and synthesis, Ch., 1, Elsevier Science Inc., 1995.

Hui Ye and Steve Young, "Perceptually weighted linear transformations for voice conversion," in Proc. of the Eurospeech'03, 2003.

Vassilis D Diakoloukas and Vassilios V Digalakis, "Maximum-likelihood stochastic-transformation adaptation of hidden markov models," Speech and Audio Processing, IEEE Transactions on, vol. 7, No. 2, pp. 177-187, 1999.

Keiichi Tokuda, Heiga Zen, and Alan W Black, "An hmm-based speech synthesis system applied to english," in Speech Synthesis, 2002. Proceedings of 2002 IEEE Workshop on. IEEE, 2002, pp. 227-230.

Daniel Erro and Asunci'on Moreno, "Frame alignment method for cross-lingual voice conversion," in Interspeech, 2007.

Kenneth Rose, "Deterministic annealing for clustering, compression, classification, regression, and related optimization problems," Proceedings of the IEEE, vol. 86, No. 11, pp. 2210-2239, 1998.

Michael Pitz, Sirko Molau, Ralf Schl¨uter, and Hermann Ney, "Vocal tract normalization equals linear transformation in cepstral space," in Proc. EuroSpeech2001, 2001.

Sankaran Panchapagesan and Abeer Alwan, "Frequency warping for vtln and speaker adaptation by linear transformation of standard mfcc," Computer speech language, vol. 23, No. 1, pp. 42-64, 2009.

Yannis Stylianou, "Applying the harmonic plus noise model in concatenative speech synthesis," Speech and Audio Processing, IEEE Transactions on, vol. 9, No. 1, pp. 21-29, 2001.

Hideki Kawahara, "Straight, exploitation of the other aspect of vocoder: Perceptually isomorphic decomposition of speech sounds," Acoustical science and technology, vol. 27, No. 6, pp. 349-353, 2006.

Daniel Erro Eslava, "Intra-lingual and cross-lingual voice conversion using harmonic plus stochastic models," Barcelona, Spain: PhD Thesis, Universitat Politechnica de Catalunya, 2008.

Shrikanth Narayanan and Dagen Wang, "Speech rate estimation via temporal correlation and selected sub-band correlation," in Proc. of the IEEE Int. Conf. on Acoustics, Speech, and Signal Processing (ICASSP). Citeseer, 2005.

Cj Leggetter and PC Woodland, "Maximum likelihood linear regression for speaker adaptation of continuous density hidden markov models," Computer speech and language, vol. 9, No. 2, pp. 171, 1995.

Mark JF Gales and PC Woodland, "Mean and variance adaptation within the mllr framework," Computer Speech and Language, vol. 10, No. 4, pp. 249-264, 1996.

Junichi Yamagishi, "Average-voice-based speech synthesis," Tokyo Institute of Technology, 2006.

Mikiko Mashimo, Tomoki Toda, Kiyohiro Shikano, and Nick Campbell, "Evaluation of crosslanguage voice conversion based on gmm and straight," 2001.

Alexander Kain and Michael W Macon, "Spectral voice conversion for text-to-speech synthesis," in Acoustics, Speech and Signal Processing, 1998. Proceedings of the 1998 IEEE International Conference on. IEEE, 1998, vol. 1, pp. 285-288.

Daisuke Saito, ShinjiWatanabe, Atsushi Nakamura, and Nobuaki Minematsu, "Statistical voice conversion based on noisy channel model," Audio, Speech, and Language Processing, IEEE Transactions on, vol. 20, No. 6, pp. 1784-1794, 2012.

David Sundermann, Antonio Bonafonte, Hermann Ney, and Harald Hoge, "A first step towards text-independent voice conversion," in Proc. of the ICSLP'04, 2004.

Arun Kumar and Ashish Verma, "Using phone and diphone based acoustic models for voice conversion: a step towards creating voice fonts," in Multimedia and Expo, 2003. ICME'03. Proceedings. 2003 International Conference on. IEEE, 2003, vol. 1, pp. I-393.

Vassilios V Digalakis, Dimitry Rtischev, and Leonardo G Neumeyer, "Speaker adaptation using constrained estimation of gaussian mixtures," Speech and Audio Processing, IEEE Transactions on, vol. 3, No. 5, pp. 357-366, 1995.

Masatsune Tamura, Takashi Masuko, Keiichi Tokuda, and Takao Kobayashi, "Adaptation of pitch and spectrum for hmm-based speech synthesis using mllr," in Acoustics, Speech, and Signal Processing, 2001. Proceedings.(ICASSP'01). 2001 IEEE International Conference on. IEEE, 2001, vol. 2, pp. 805-808.

M-W Feng, Richard Schwartz, Francis Kubala, and John Makhoul, "Iterative normalization for speaker-adaptive training in continuous speech recognition," in Acoustics, Speech, and Signal Processing, 1989. ICASSP-89., 1989 International Conference on. IEEE, 1989, pp. 612-615.

H Valbret, E Moulines, and Jean-Pierre Tubach, "Voice transformation using psola technique," Speech Communication, vol. 11, No. 2, pp. 175-187, 1992.

Daniel Erro, Inaki Sainz, Eva Navas, and Inma Hern'aez, "Improved hnm-based vocoder for statistical synthesizers," in Proc. Interspeech, 2011, pp. 1809-1812.

Yamato Ohtani, Tomoki Toda, Hiroshi Saruwatari, and Kiyohiro Shikano, "Maximum likelihood voice conversion based on gmm with straight mixed excitation," in Proc. ICSLP, 2006, pp. 2266-2269.

R Faltlhauser, T Pfau, and G Ruske, "On-line speaking rate estimation using gaussian mixture models,"in Acoustics, Speech, and Signal Processing, 2000. ICASSP'00. Proceedings. 2000 IEEE International Conference on. IEEE, 2000, vol. 3, pp. 1355-1358.

Daniel Erro, Asunci'on Moreno, and Antonio Bonafonte, "Inca algorithm for training voice conversion.systems from nonparallel corpora," Audio, Speech, and Language Processing, IEEE Transactions on, vol. 18, No. 5, pp. 944-953, 2010.

Athanasios Mouchtaris, Jan Van der Spiegel, and Paul Mueller, "Non-parallel training for voice conversion by maximum likelihood constrained adaptation," in Acoustics, Speech, and Signal Processing, 2004. Proceedings.(ICASSP'04). IEEE International Conference on. IEEE, 2004, vol. 1, pp. 1-1.

Heiga Zen, Keiichi Tokuda, and Alan W Black, "Statistical parametric speech synthesis," Speech Communication, vol. 51, No. 11, pp. 1039-1064, 2009.

Junichi Yamagishi, Takashi Nose, Heiga Zen, Zhen-Hua Ling, Tomoki Toda, Keiichi Tokuda, Simon King, and Steve Renals, "Robust speaker-adaptive hmm-based text-to-speech synthesis," Audio, Speech, and Language Processing, IEEE Transactions on, vol. 17, No. 6, pp. 1208-1230, 2009.

Yi-Jian Wu, Yoshihiko Nankaku, and Keiichi Tokuda, "State mapping based method for cross-lingual speaker adaptation in hmm-based speech synthesis," in Proc. of Interspeech, 2009, pp. 528-531.

(56) References Cited

OTHER PUBLICATIONS

Robert J McAulay and Thomas F Quatieri, "Computationally efficient sine-wave synthesis and its application to sinusoidal transform coding," in Acoustics, Speech, and Signal Processing, 1988. ICASSP-88., 1988 International Conference on. IEEE, 1988, pp. 370-373.

Xianglin Peng, Keiichiro Oura, Yoshihiko Nankaku, and Keiichi Tokuda, "Cross-lingual speaker adaptation for hmm-based speech synthesis considering differences between language-dependent average voices," in Signal Processing (ICSP), 2010 IEEE 10th International Conference on. IEEE, 2010, pp. 605-608.

Junichi Yamagishi, "Average-Voice-Based Speech Synthesis" PhD Thesis, 2006.

Junichi Yamagishi, Bela Usabaev, Simon King, Oliver Watts, John Dines, Jilei Tian, Rile Hu, Keiichiro Oura, Keiichi Tokuda, Reima Karhila, Mikko Kurimo, "Thousands of Voices for HMM-based Speech Synthesis," Interspeech 2009, 10th Annual Conference of the International Speech Communication Association, Brighton, United Kingdom, Sep. 6-10, 2009.

Vincent Wan, Javier Latorre, Kayoko Yanagisawa, Norbert Braunschweiler, Langzhou Chen, Mark J. F. Gales, and Masami Akamine, "Building HMM-TTS Voices on Diverse Data," IEEE Journal of Selected Topics in Signal Processing, Vol. 8, No. 2, Apr. 2014, pp. 296-306.

Junichi Yamagishi, Oliver Watts, Simon King, Bela Usabaev, "Roles of the Average Voice in Speaker-adaptive HMM-based Speech Synthesis," Interspeech 2010, Sep. 26-30, 2010, Makuhari, Chiba, Japan, pp. 418-421.

Alan W Black, Heiga Zen, and Keiichi Tokuda, "Statistical Parametric Speech Synthesis," ICASSP 2007, pp. IV-1229-IV-1232.

Mouchtaris et al., "Non-Parallel Training for Voice Conversion by Maximum Likelihood Constrained Adaptation," Proceedings of the IEEE International Conference on Acoustics, Speech, and Signal Processing 2004 (ICASSP 2004), vol. 1, pp. 1-1 to 1-4.

* cited by examiner

METHOD AND SYSTEM FOR BUILDING TEXT-TO-SPEECH VOICE FROM DIVERSE RECORDINGS

BACKGROUND

Unless otherwise indicated herein, the materials described in this section are not prior art to the claims in this application and are not admitted to be prior art by inclusion in this section.

A goal of automatic speech recognition (ASR) technology is to map a particular utterance, or speech sample, to an accurate textual representation, or other symbolic representation, of that utterance. For instance, ASR performed on the utterance "my dog has fleas" would ideally be mapped to the text string "my dog has fleas," rather than the nonsensical text string "my dog has freeze," or the reasonably sensible but inaccurate text string "my bog has trees."

A goal of speech synthesis technology is to convert written language into speech that can be output in an audio format, for example directly or stored as an audio file suitable for audio output. The written language could take the form of text, or symbolic linguistic representations. The speech may be generated as a waveform by a speech synthesizer, which produces artificial human speech. Natural sounding human speech may also be a goal of a speech synthesis system.

Various technologies, including computers, network servers, telephones, and personal digital assistants (PDAs), can be employed to implement an ASR system and/or a speech synthesis system, or one or more components of such systems. Communication networks may in turn provide communication paths and links between some or all of such devices, supporting speech synthesis system capabilities and services that may utilize ASR and/or speech synthesis system capabilities.

BRIEF SUMMARY

In one aspect, an example embodiment presented herein provides a method comprising: extracting speech features from a plurality of recorded reference speech utterances of a reference speaker to generate a reference set of reference-speaker vectors; for each respective plurality of recorded colloquial speech utterances of a respective colloquial speaker of multiple colloquial speakers, extracting speech features from the recorded colloquial speech utterances of the respective colloquial speaker to generate a respective set of colloquial-speaker vectors; for each respective set of colloquial-speaker vectors, replacing each colloquial-speaker vector of the respective set of colloquial-speaker vectors with a respective, optimally-matched reference-speaker vector from among the reference set of reference-speaker vectors, the respective, optimally-matched reference-speaker vector being identified by matching under a transform that compensates for differences in speech between the reference speaker and the respective colloquial speaker; aggregating the replaced colloquial-speaker vectors of all the respective sets of colloquial-speaker vectors into an aggregate set of conditioned speaker vectors; providing the aggregate set of conditioned speaker vectors to a text-to-speech (TTS) system implemented on one or more computing devices; and training the TTS system using the provided aggregate set of conditioned speaker vectors.

In another respect, an example embodiment presented herein provides a system comprising: one or more processors; memory; and machine-readable instructions stored in the memory, that upon execution by the one or more processors cause the system to carry out operations including: extracting speech features from a plurality of recorded reference speech utterances of a reference speaker to generate a reference set of reference-speaker vectors, for each respective plurality of recorded colloquial speech utterances of a respective colloquial speaker of multiple colloquial speakers, extracting speech features from the recorded colloquial speech utterances of the respective colloquial speaker to generate a respective set of colloquial-speaker vectors, for each respective set of colloquial-speaker vectors, replacing each colloquial-speaker vector of the respective set of colloquial-speaker vectors with a respective, optimally-matched reference-speaker vector from among the reference set of reference-speaker vectors, wherein the respective, optimally-matched reference-speaker vector is identified by matching under a transform that compensates for differences in speech between the reference speaker and the respective colloquial speaker, aggregating the replaced colloquial-speaker vectors of all the respective sets of colloquial-speaker vectors into an aggregate set of conditioned speaker vectors, providing the aggregate set of conditioned speaker vectors to a text-to-speech (TTS) system, and training the TTS system using the provided aggregate set of conditioned speaker vectors.

In yet another aspect, an example embodiment presented herein provides an article of manufacture including a computer-readable storage medium having stored thereon program instructions that, upon execution by one or more processors of a system, cause the system to perform operations comprising: extracting speech features from a plurality of recorded reference speech utterances of a reference speaker to generate a reference set of reference-speaker vectors; for each respective plurality of recorded colloquial speech utterances of a respective colloquial speaker of multiple colloquial speakers, extracting speech features from the recorded colloquial speech utterances of the respective colloquial speaker to generate a respective set of colloquial-speaker vectors; for each respective set of colloquial-speaker vectors, replacing each colloquial-speaker vector of the respective set of colloquial-speaker vectors with a respective, optimally-matched reference-speaker vector from among the reference set of reference-speaker vectors, wherein the respective, optimally-matched reference-speaker vector is identified by matching under a transform that compensates for differences in speech between the reference speaker and the respective colloquial speaker; aggregating the replaced colloquial-speaker vectors of all the respective sets of colloquial-speaker vectors into an aggregate set of conditioned speaker vectors; providing the aggregate set of conditioned speaker vectors to a text-to-speech (TTS) system implemented on one or more computing devices; and training the TTS system using the provided aggregate set of conditioned speaker vectors.

These as well as other aspects, advantages, and alternatives will become apparent to those of ordinary skill in the art by reading the following detailed description, with reference where appropriate to the accompanying drawings. Further, it should be understood that this summary and other descriptions and figures provided herein are intended to illustrative embodiments by way of example only and, as such, that numerous variations are possible. For instance, structural elements and process steps can be rearranged, combined, distributed, eliminated, or otherwise changed, while remaining within the scope of the embodiments as claimed.

DETAILED DESCRIPTION

1. Overview

Figure 1:
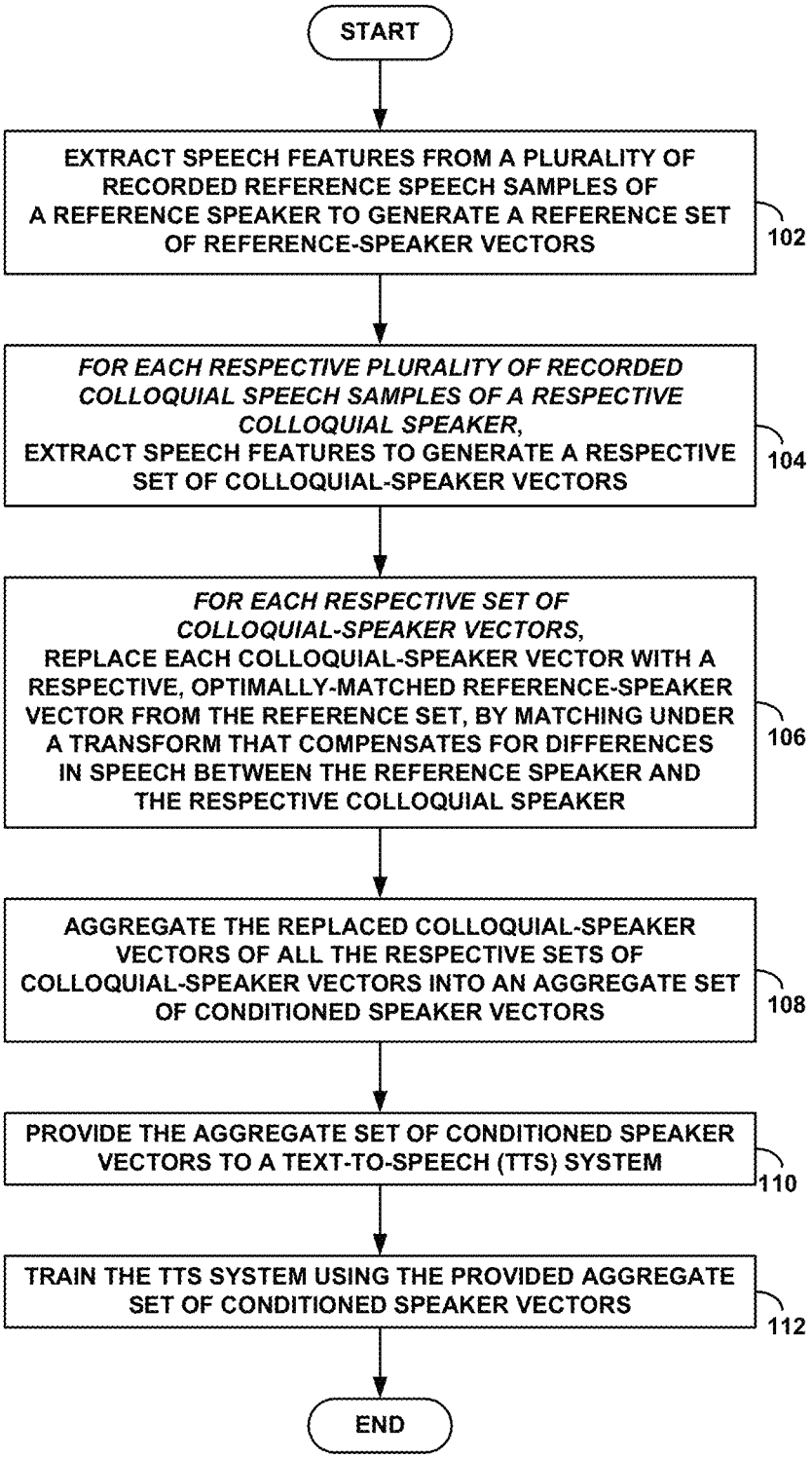
FIG. 1 is a flowchart illustrating an example method in accordance with an example embodiment.

A speech synthesis system can be a processor-based system configured to convert written language into artificially produced speech or spoken language. The written language could be written text, such as one or more written sentences or text strings, for example. The written language could also take the form of other symbolic representations, such as a speech synthesis mark-up language, which may include information indicative of speaker emotion, speaker gender, speaker identification, as well as speaking styles. The source of the written text could be input from a keyboard or keypad of a computing device, such as a portable computing device (e.g., a PDA, smartphone, etc.), or could be from file stored on one or another form of computer readable storage medium. The artificially produced speech could be generated as a waveform from a signal generation device or module (e.g., a speech synthesizer device), and output by an audio playout device and/or formatted and recorded as an audio file on a tangible recording medium. Such a system may also be referred to as a "text-to-speech" (TTS) system, although the written form may not necessarily be limited to only text.

A speech synthesis system may operate by receiving an input text string (or other form of written language), and translating the written text into an "enriched transcription" corresponding to a symbolic representation of how the spoken rendering of the text sounds or should sound. The enriched transcription may then be mapped to speech features that parameterize an acoustic rendering of the enriched transcription, and which then serve as input data to a signal generation module device or element that can produce an audio waveform suitable for playout by an audio output device. The playout may sound like a human voice speaking the words (or sounds) of the input text string, for example. In the context of speech synthesis, the more natural the sound (e.g., to the human ear) of the synthesized voice, generally the better the voice-quality ranking of the system. The audio waveform could also be generated as an audio file that may be stored or recorded on storage media suitable for subsequent playout.

In operation, a TTS system may be used to convey information from an apparatus (e.g. a processor-based device or system) to a user, such as messages, prompts, answers to questions, instructions, news, emails, and speech-to-speech translations, among other information. Speech signals may themselves carry various forms or types of information, including linguistic content, affectual state (e.g., emotion and/or mood), physical state (e.g., physical voice characteristics), and speaker identity, to name a few.

Speech synthesis based on associating parametric representations of speech with symbolic descriptions of phonetic and linguistic content of text (such as enriched transcriptions) is customarily referred to as "statistical parametric speech synthesis" (or "SPSS"). A SPSS system may be trained using data consisting mainly of numerous speech samples and corresponding text strings (or other symbolic renderings). For practical reasons, the speech samples are usually recorded, although they need not be in principle. By construction, the corresponding text strings are in, or generally accommodate, a written storage format. Recorded speech samples and their corresponding text strings can thus constitute training data for a SPSS system.

One example of a SPSS system is TTS based on hidden Markov models (HMMs). In this approach, HMMs are used to model statistical probabilities associating enriched transcriptions of input text strings with parametric representations of the corresponding speech to be synthesized. One advantageous aspect of HMM-based speech synthesis is that it can facilitate altering or adjusting characteristics of the synthesized voice using one or another form of statistical adaptation. For example, given data in the form of recordings of a reference speaker, the HMM can be adapted to the data so as to make the HMM-based synthesizer sound like the reference speaker. The ability to adapt HMM-based synthesis can therefore make it a flexible approach.

In another example of a SPSS system, a TTS system may use a form of machine learning to generate a parametric representation of speech to synthesize speech. For example, a neural network (NN) may be used to generate speech parameters by training the NN to associated known enriched transcriptions with known parametric representations of speech sounds. As with HMM-based speech synthesis, NN-based speech synthesis can facilitate altering or adjusting characteristics of the synthesized voice using one or another form of statistical adaptation.

In a typical, conventional approach, SPSS uses homogeneous data from a single speaker with a consistent speaking style, recorded under controlled conditions. For example, consistency of recorded speech samples can help ensure that a SPSS system "learns," or is trained, to associate a consistent parametric representation of speech sounds with their corresponding enriched transcriptions. Controlled recording conditions can similarly help mitigate potential polluting effects of noise or other extraneous background that can distort parametric representations during training and diminish the quality of the training. In a similar vein, the larger the database of recorded samples—particularly those recorded under controlled conditions—the better the training of a SPSS system, and thus the better the accuracy of the TTS performance and the quality of the synthesized speech.

Obtaining large, high-quality speech databases for training of SPSS systems can be expensive in terms of cost and time, and may not scale up well. On the other hand, obtaining audio recordings from multiple speakers in diverse recording environments can be considerably cheaper in terms of time and effort, and may be a more scalable approach. For example, large collections of such diversely-recorded speech and associated text are often employed in automatic speech recognition (ASR) systems, where diversity and variability of speakers and recording environments can be a benefit to the training process. However, conventional techniques and approaches for merging diverse speech databases for SPSS purposes of training generally require computationally expensive and/or complex algorithms that clean and normalize the quality of the audio, as well as non-trivial speaker normalization algorithms.

In view of these challenges, it would be desirable to be able to build high-quality SPSS systems using recordings from multiple speakers in different recording environments in a way that overcomes the significant drawbacks of conventional approaches. At a practical level, the general availability such diverse speech databases—either ones employed by ASR systems, or from multiple Internet sources, for example—warrants devising a technically superior and cost-effective technique for merging diverse speech databases for SPSS training.

But there may be additional reasons, beyond the availability considerations. In particular, there can be a relative paucity of large, uniform and high-quality speech databases for certain languages spoken by numerous smaller populations that, together, can account for a very large total number of languages. Such languages are sometimes referred to as "long-tail" languages, because the individual populations that speak them occupy the "tail" of a number or frequency distribution of speakers of all languages: any given language in the tail may represent a relatively small population, but the total of all languages in the tail can still represent a large total population. One consequence of a relative lack of high-quality speech databases for long-tail languages can be a reduced number, and/or diminished quality, of TTS-based services for the populations that speak these languages.

Accordingly, the ability to build high-quality SPSS systems using recordings from multiple speakers in different recording environments, in a technically superior and cost-effective manner, could transform the potential scalability offered by the generally availability diverse-speaker recordings into practice. And because obtaining large numbers of diverse recordings of long-tail languages can be more practical than obtaining large, uniform speech databases of these languages, overcoming technical and practical challenges of building diverse-recording-based SPSS can also help make TTS-based services more widely available in long-tail languages, as well as more generally in other circumstances.

Hence, example embodiments are described herein for a method and system for building high-quality SPSS using recordings from multiple speakers acquired in different recording environments. More particularly, recorded speech samples of multiple speakers of a given language acquired in diverse recording environments can be conditioned using a database of recorded speech samples of a reference speaker of a reference language acquired under controlled conditions. Conditioning techniques applied to the recordings of the multiple speakers can enable the diverse recordings to be conditioned and subsequently aggregated into a conditioned speech database that can be used build and train a high-quality SPSS system in the given language.

In accordance with example embodiments, recorded samples of speech recited in a consistent voice by a reference speaker reading specified text in a reference language can represent a high-quality speech database, referred to herein as the "reference speech database." For example, the reference speech database could contain speech samples (and associated text) of a single reference speaker obtained under controlled recording conditions. Such a database might be obtained specifically for a SPSS system, with non-trivial emphasis placed on factors that help insure overall quality, such as speaking skills and training of the reference speaker.

Also in accordance with example embodiments, each of multiple speakers reciting written text in a given language under possibly ad hoc (or less controlled) recording conditions can be collected in respective "ordinary," or ad hoc, quality speech databases. In acquiring these speech databases, more emphasis may be placed on the number of speakers and the total volume of speech samples in all the speech databases than on the quality and speech training of the individual speakers, or on the recording conditions under which the speech samples are obtained. For example, these speech databases may be obtained from the Internet, or simply "man-to-the-street" recordings. In order to signify a sort of generalized impact of a relatively diminished emphasis on speaker consistency, speech quality, and/or control of recording conditions—either intentional or due to circumstances of data acquisition—the term "colloquial" will be used herein as a qualitative descriptor in referring to the multiple speakers, the speech samples acquired from them, and the databases containing the speech samples. To maintain consistency of terminology, the term "colloquial language" will also be used to refer to the language of a colloquial speaker.

The reference language and the colloquial language need not be the same, although they may be lexically related, or be characterized as phonetically similar. In an example embodiment, the colloquial language could be a long-tail language, and the reference language could be phonetically similar but more widely spoken. As such, a large speech database of the reference language may be readily available or relatively easy to acquire. Applying the conditioning techniques described herein can therefore enable construction of a high-quality SPSS system in the long-tail language (or more generally, in the colloquial language).

In accordance with example embodiments, the reference speech samples in the reference speech database can be processed into a sequence of temporal frames of parameterized reference-speech sounds. The reference text strings associated with each reference speech sample can be processed into a corresponding enriched transcription including a sequence of reference "enriched labels." Each temporal frame of parameterized reference speech sound can thus be associated with some number of reference enriched labels.

The association can be many-to-one, one-to-one, or one-to-many. Customarily, each such temporal frame of parameterized speech sound is typically referred to as a speaker "feature vector." For purposes of the discussion herein, feature vectors derived or extracted from speech of the reference speaker will be referred to reference-speaker vectors.

Similarly, the colloquial speech samples in the colloquial speech databases can be processed into a sequence of temporal frames of parameterized colloquial-speech sounds. The colloquial text strings associated with each colloquial speech sample can be processed into a corresponding enriched transcription including a sequence of colloquial enriched labels. Each temporal frame of parameterized colloquial speech sound can thus be associated with some number of colloquial enriched labels. Again, the association can be many-to-one, one-to-one, or one-to-many. For purposes of the discussion herein, feature vectors derived or extracted from speech of the colloquial speaker will be referred to colloquial-speaker vectors.

In accordance with example embodiments, the colloquial-speaker vectors from each colloquial speech database can be conditioned using the reference-speaker vectors from the reference speech database by replacing each colloquial-speaker vector with an optimally-matched reference-speaker vector. More particularly, an analytical matching procedure can be carried out to identify for each colloquial-speaker vector a closest match reference-speaker vector from among the set of reference-speaker vectors. This process is enabled by a novel and effective "matching under transform" ("MUT") technique, and results in determination of reference-speaker vectors that most closely parameterize the sounds represented in the colloquial-speaker vectors, but do so in a way characterized by the voice consistency and controlled recording conditions of the reference speech database. Each colloquial-speaker vector can then be replaced with its optimally-matched reference-speaker vector, while at the same time retaining the enriched colloquial labels associated with each colloquial-speaker vector. Replacing the colloquial-speaker vectors with the identified, optimally-match reference-speaker vectors thereby yields a set of replaced speaker vectors that represent the speech sounds of the colloquial speakers, but with the quality and consistency of the reference speech database.

Also in accordance with example embodiments, the matching and replacing steps can be carried out separately for each colloquial speech database. Doing so can help mitigate effects of inconsistencies between different colloquial speech databases, even if the consistency and/or or quality within each colloquial speech database is relatively diminished in comparison with the reference speech database. All of the replaced speaker vectors and their associated enriched colloquial labels can be aggregated into a conditioned aggregate speech database, which is of high quality and suitable for training a SPSS system in the colloquial language.

The MUT technique entails a matching procedure that can compensate for inter-speaker speech differences (e.g., differences between the reference speaker and the colloquial speakers). The matching procedure can be specified in terms of a MUT algorithm suitable for implementation as executable instructions on one or more processors of a system, such as a SPSS or TTS system. Taken with additional steps described below, MUT can be used to construct a high-quality speech database from a collection of multiple colloquial speech databases.

2. Example Method

In example embodiments, an example method can be implemented as machine-readable instructions that when executed by one or more processors of a system cause the system to carry out the various functions, operations and tasks described herein. In addition to the one or more processors, the system may also include one or more forms of memory for storing the machine-readable instructions of the example method (and possibly other data), as well as one or more input devices/interfaces, one or more output devices/interfaces, among other possible components. Some or all aspects of the example method may be implemented in a TTS synthesis system, which can include functionality and capabilities specific to TTS synthesis. However, not all aspects of an example method necessarily depend on implementation in a TTS synthesis system.

In example embodiments, a TTS synthesis system may include one or more processors, one or more forms of memory, one or more input devices/interfaces, one or more output devices/interfaces, and machine-readable instructions that when executed by the one or more processors cause the TTS synthesis system to carry out the various functions and tasks described herein. The TTS synthesis system may also include implementations based on one or more hidden Markov models. In particular, the TTS synthesis system may employ methods that incorporate HMM-based speech synthesis, as well as other possible components. Additionally or alternatively, the TTS synthesis system may also include implementations based on one or more neural networks (NNs). In particular, the TTS synthesis system may employ methods that incorporate NN-based speech synthesis, as well as other possible components.

FIG. 1 is a flowchart illustrating an example method in accordance with example embodiments. At step 102, speech features are extracted from a plurality of recorded reference speech utterances of a reference speaker to generate a reference set of reference-speaker vectors. More particularly, each of the reference-speaker vectors of the reference set corresponds to a feature vector of a temporal frame of a reference speech utterance, and each reference speech utterance can span multiple temporal frames.

At step 104, for each respective plurality of recorded colloquial speech utterances of a respective colloquial speaker of multiple colloquial speakers, a respective set of colloquial-speaker vectors is generated by extracting speech features from the recorded colloquial speech utterances of the respective colloquial. As with the reference-speaker vectors, each of the colloquial-speaker vectors of each respective set corresponds to a feature vector of a temporal frame of a colloquial speech utterance, and each colloquial speech utterance can span multiple temporal frames.

At step 106, for each respective set of colloquial-speaker vectors, each colloquial-speaker vector of the respective set of colloquial-speaker vectors is replaced with a respective, optimally-matched reference-speaker vector from among the reference set of reference-speaker vectors. In accordance with example embodiments, the respective, optimally-matched reference-speaker vector is identified by matching under a transform that compensates for differences in speech between the reference speaker and the respective colloquial speaker.

At step 108, the replaced colloquial-speaker vectors of all the respective sets of colloquial-speaker vectors are aggregated into an aggregate set of conditioned speaker vectors.

At step 110, the aggregate set of conditioned speaker vectors is provided to a text-to-speech (TTS) system implemented on one or more computing devices. For example, the TTS system can be configured to receive the aggregate set of conditioned speaker vectors as input. As such, providing the aggregate set of conditioned speaker vectors to the TTS system can correspond to providing particular input to the TTS system.

Finally, at step 112, the TTS system is trained using the provided aggregate set of conditioned speaker vectors. As described below, training a TTS system using speaker vectors can entail training the TTS system to associate a transcribed form of text with parameterized speech, such as is represented in feature vectors.

In accordance with example embodiments, replacing each colloquial-speaker vector of the respective set of colloquial-speaker vectors with the respective, optimally-matched reference-speaker vector can entail retaining an enriched transcription associated each given colloquial-speaker vector that is replaced in each respective set of colloquial-speaker vectors. More particularly, as described above, each given colloquial-speaker vector of each respective set of colloquial-speaker vectors corresponds to a feature vector extracted from a temporal frame of a particular recorded colloquial speech utterance. In accordance with example embodiments, each recorded colloquial speech utterance has an associated text string, and each text string can be processed to derive an enriched transcription. By way of example, an enriched transcription can include phonetic labels and descriptors of syntactic and linguistic content. Thus, each given colloquial-speaker vector has an associated enriched transcription derived from a respective text string associated with the particular recorded colloquial speech utterance from which the given colloquial-speaker vector was extracted. As each colloquial-speaker vector is replaced in accordance with step 106, the associated enriched transcription for the replaced colloquial-speaker vector is retained (i.e., not replaced).

In further accordance with example embodiments, aggregating the replaced colloquial-speaker vectors of all the respective sets of colloquial-speaker vectors into the aggregate set of conditioned speaker vectors can entail constructing a speech corpus that includes the replaced colloquial-speaker vectors of all the respective sets of colloquial-speaker vectors and the retained enriched transcriptions associated with each given colloquial-speaker vector that was replaced. More particularly, the speech corpus can be a training database for a TTS system.

Also in accordance with example embodiments, replacing the colloquial-speaker vectors of each respective set of colloquial-speaker vectors entails doing so one respective set at a time. More particularly, all of the colloquial-speaker vectors of a given, respective set are individually matched and replaced with a respective, optimally-matched reference-speaker vector from among the reference set in a plurality of match-and-replace operations separate from that applied to the colloquial-speaker vectors of any of the other respective sets. As described below, carrying out the match-and-replace operations one respective set at a time helps mitigate possible inconsistencies between respective sets, particularly in regards to the matching technique, which accounts for statistical characteristics within each respective set.

As described above, extracting speech features from recorded reference speech utterances and from the recorded colloquial speech utterances can entail generating feature vectors. More specifically, and in accordance with example embodiments, extracting speech features from recorded reference speech utterances of the reference speaker can entail decomposing the recorded reference speech utterances of the reference speaker into reference temporal frames of parameterized reference speech units. Each reference temporal frame can correspond to a respective reference-speaker vector of speech features. By way of example, the speech features can include spectral envelope parameters, aperiodicity envelope parameters, fundamental frequencies, and/or voicing, of a respective reference speech unit.

Similarly, and also in accordance with example embodiments, extracting speech features from recorded colloquial speech utterances of the colloquial speaker can entail decomposing the recorded colloquial speech utterances of the colloquial speaker into colloquial temporal frames of parameterized colloquial speech units. Each colloquial temporal frame can correspond to a respective colloquial-speaker vector of speech features. Again, by way of example, the speech features can include spectral envelope parameters, aperiodicity envelope parameters, fundamental frequencies, and/or voicing, of a respective reference speech unit.

By way of example, and in accordance with example embodiments, the reference speech units can correspond to one phonemes, triphone, or other context-sequences of phonemes. Similarly, and also in accordance with example embodiments, the colloquial speech units can correspond to one phonemes, triphone, or other context-sequences of phonemes.

In further accordance with example embodiments, replacing each colloquial-speaker vector of each respective set of colloquial-speaker vectors with the respective, optimally-matched reference-speaker vector from among the reference set of reference-speaker vectors can entail optimally matching speech features of the colloquial-speaker vectors with speech features of the reference-speaker vectors. More specifically, for each respective colloquial-speaker vector, an optimal match between its speech features and the speech features of a particular one of the reference-speaker vectors can be determined. In accordance with example embodiments, the optimal match can be determined under a transform that compensates for differences in speech between the reference speaker and each respective colloquial speaker. Then, for each respective colloquial-speaker vector, its speech features are replaced with the speech features of the determined particular one of the reference-speaker vectors.

In further accordance with example embodiments, the spectral envelope parameters of each vector of reference speech features can be Mel Cepstral coefficients, Line Spectral Pairs, Linear Predictive coefficients, and/or Mel-Generalized Cepstral Coefficients. In addition, indicia of first and second time derivatives of the spectral envelope parameters can be included. Similarly, the spectral envelope parameters of each vector of colloquial speech features can be Mel Cepstral coefficients, Line Spectral Pairs, Linear Predictive coefficients, and/or Mel-Generalized Cepstral Coefficients. Again, indicia of first and second time derivatives of the spectral envelope parameters can be included as well.

In accordance with example embodiments, the recorded reference speech utterances of the reference speaker can be in a reference language and the colloquial speech utterances of all the respective colloquial speakers can all be in a colloquial language. In one example, wherein colloquial language can be lexically related to the reference language. In a further example, the colloquial language and a lexically-related reference language can be different. Then, in still further accordance with example embodiments, training the TTS system using the provided aggregate set of conditioned speaker vectors can entail training the TTS system to synthesize speech in the colloquial language, but in a voice of the reference speaker.

It will be appreciated that the steps shown in FIG. 1 are meant to illustrate a method in accordance with example embodiments. As such, various steps could be altered or modified, the ordering of certain steps could be changed, and additional steps could be added, while still achieving the overall desired operation.

3. Example Communication System and Device Architecture

Methods in accordance with an example embodiment, such as the on described above, devices, could be implemented using so-called "thin clients" and "cloud-based" server devices, as well as other types of client and server devices. Under various aspects of this paradigm, client devices, such as mobile phones and tablet computers, may offload some processing and storage responsibilities to remote server devices. At least some of the time, these client services are able to communicate, via a network such as the Internet, with the server devices. As a result, applications that operate on the client devices may also have a persistent, server-based component. Nonetheless, it should be noted that at least some of the methods, processes, and techniques disclosed herein may be able to operate entirely on a client device or a server device.

This section describes general system and device architectures for such client devices and server devices. However, the methods, devices, and systems presented in the subsequent sections may operate under different paradigms as well. Thus, the embodiments of this section are merely examples of how these methods, devices, and systems can be enabled.

a. Example Communication System

Figure 2:
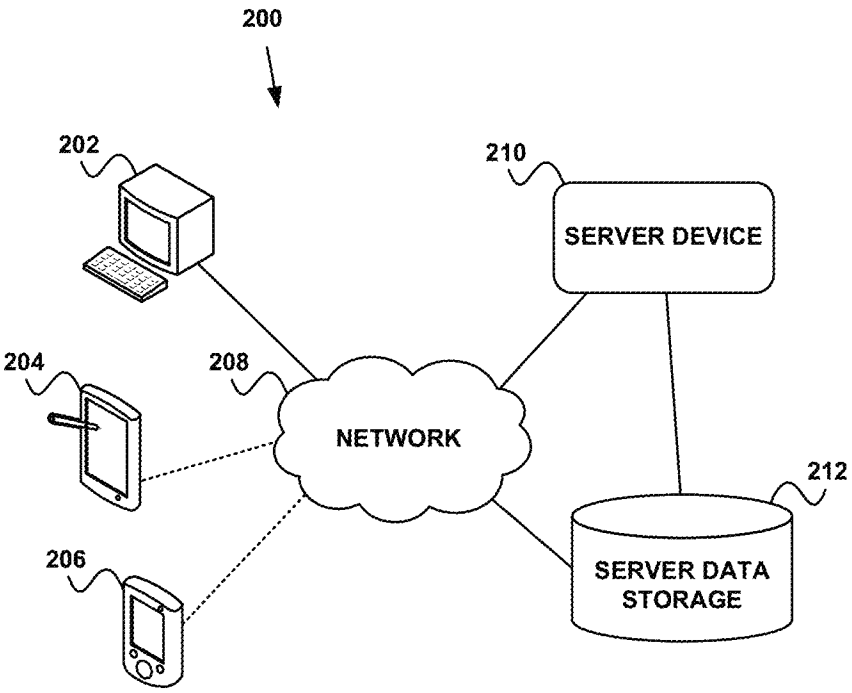
FIG. 2 is a block diagram of an example network and computing architecture, in accordance with an example embodiment.

FIG. 2 is a simplified block diagram of a communication system 200, in which various embodiments described herein can be employed. Communication system 200 includes client devices 202, 204, and 206, which represent a desktop personal computer (PC), a tablet computer, and a mobile phone, respectively. Client devices could also include wearable computing devices, such as head-mounted displays and/or augmented reality displays, for example. Each of these client devices may be able to communicate with other devices (including with each other) via a network 208 through the use of wireline connections (designated by solid lines) and/or wireless connections (designated by dashed lines).

Network 208 may be, for example, the Internet, or some other form of public or private Internet Protocol (IP) network. Thus, client devices 202, 204, and 206 may communicate using packet-switching technologies. Nonetheless, network 208 may also incorporate at least some circuit-switching technologies, and client devices 202, 204, and 206 may communicate via circuit switching alternatively or in addition to packet switching.

A server device 210 may also communicate via network 208. In particular, server device 210 may communicate with client devices 202, 204, and 206 according to one or more network protocols and/or application-level protocols to facilitate the use of network-based or cloud-based computing on these client devices. Server device 210 may include integrated data storage (e.g., memory, disk drives, etc.) and may also be able to access a separate server data storage 212. Communication between server device 210 and server data storage 212 may be direct, via network 208, or both direct and via network 208 as illustrated in FIG. 2. Server data storage 212 may store application data that is used to facilitate the operations of applications performed by client devices 202, 204, and 206 and server device 210.

Although only three client devices, one server device, and one server data storage are shown in FIG. 2, communication system 200 may include any number of each of these components. For instance, communication system 200 may comprise millions of client devices, thousands of server devices and/or thousands of server data storages. Furthermore, client devices may take on forms other than those in FIG. 2.

b. Example Server Device and Server System

Figure 3A:
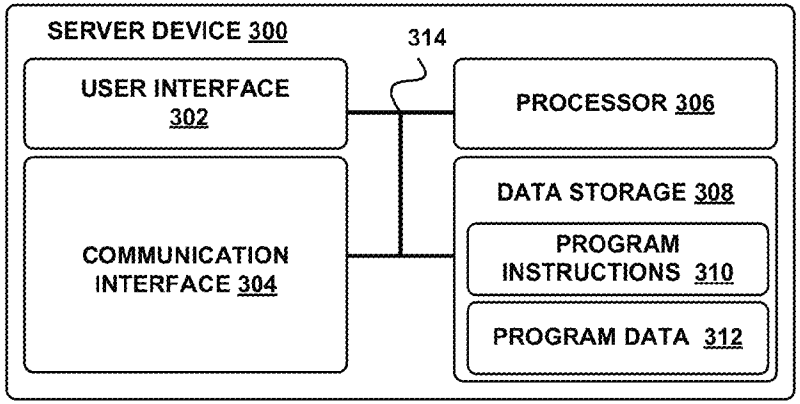
FIG. 3A is a block diagram of a server device, in accordance with an example embodiment.

FIG. 3A is a block diagram of a server device in accordance with an example embodiment. In particular, server device 300 shown in FIG. 3A can be configured to perform one or more functions of server device 210 and/or server data storage 212. Server device 300 may include a user interface 302, a communication interface 304, processor 306, and data storage 308, all of which may be linked together via a system bus, network, or other connection mechanism 314.

User interface 302 may comprise user input devices such as a keyboard, a keypad, a touch screen, a computer mouse, a track ball, a joystick, and/or other similar devices, now known or later developed. User interface 302 may also comprise user display devices, such as one or more cathode ray tubes (CRT), liquid crystal displays (LCD), light emitting diodes (LEDs), displays using digital light processing (DLP) technology, printers, light bulbs, and/or other similar devices, now known or later developed. Additionally, user interface 302 may be configured to generate audible output(s), via a speaker, speaker jack, audio output port, audio output device, earphones, and/or other similar devices, now known or later developed. In some embodiments, user interface 302 may include software, circuitry, or another form of logic that can transmit data to and/or receive data from external user input/output devices.

Communication interface 304 may include one or more wireless interfaces and/or wireline interfaces that are configurable to communicate via a network, such as network 208 shown in FIG. 2. The wireless interfaces, if present, may include one or more wireless transceivers, such as a BLUETOOTH® transceiver, a Wifi transceiver perhaps operating in accordance with an IEEE 802.11 standard (e.g., 802.11b, 802.11g, 802.11n), a WiMAX transceiver perhaps operating in accordance with an IEEE 802.16 standard, a Long-Term Evolution (LTE) transceiver perhaps operating in accordance with a 3rd Generation Partnership Project (3GPP) standard, and/or other types of wireless transceivers configurable to communicate via local-area or wide-area wireless networks. The wireline interfaces, if present, may include one or more wireline transceivers, such as an Ethernet transceiver, a Universal Serial Bus (USB) transceiver, or similar transceiver configurable to communicate via a twisted pair wire, a coaxial cable, a fiber-optic link or other physical connection to a wireline device or network.

In some embodiments, communication interface 304 may be configured to provide reliable, secured, and/or authenticated communications. For each communication described herein, information for ensuring reliable communications (e.g., guaranteed message delivery) can be provided, perhaps as part of a message header and/or footer (e.g., packet/ message sequencing information, encapsulation header(s) and/or footer(s), size/time information, and transmission verification information such as cyclic redundancy check (CRC) and/or parity check values). Communications can be made secure (e.g., be encoded or encrypted) and/or decrypted/decoded using one or more cryptographic protocols and/or algorithms, such as, but not limited to, the data encryption standard (DES), the advanced encryption standard (AES), the Rivest, Shamir, and Adleman (RSA) algorithm, the Diffie-Hellman algorithm, and/or the Digital Signature Algorithm (DSA). Other cryptographic protocols and/or algorithms may be used instead of or in addition to those listed herein to secure (and then decrypt/decode) communications.

Processor 306 may include one or more general purpose processors (e.g., microprocessors) and/or one or more special purpose processors (e.g., digital signal processors (DSPs), graphical processing units (GPUs), floating point processing units (FPUs), network processors, or application specific integrated circuits (ASICs)). Processor 306 may be configured to execute computer-readable program instructions 310 that are contained in data storage 308, and/or other instructions, to carry out various functions described herein.

Data storage 308 may include one or more non-transitory computer-readable storage media that can be read or accessed by processor 306. The one or more computer-readable storage media may include volatile and/or non-volatile storage components, such as optical, magnetic, organic or other memory or disc storage, which can be integrated in whole or in part with processor 306. In some embodiments, data storage 308 may be implemented using a single physical device (e.g., one optical, magnetic, organic or other memory or disc storage unit), while in other embodiments, data storage 308 may be implemented using two or more physical devices.

Data storage 308 may also include program data 312 that can be used by processor 306 to carry out functions described herein. In some embodiments, data storage 308 may include, or have access to, additional data storage components or devices (e.g., cluster data storages described below).

Referring again briefly to FIG. 2, server device 210 and server data storage device 212 may store applications and application data at one or more locales accessible via network 208. These locales may be data centers containing numerous servers and storage devices. The exact physical location, connectivity, and configuration of server device 210 and server data storage device 212 may be unknown and/or unimportant to client devices. Accordingly, server device 210 and server data storage device 212 may be referred to as "cloud-based" devices that are housed at various remote locations. One possible advantage of such "cloud-based" computing is to offload processing and data storage from client devices, thereby simplifying the design and requirements of these client devices.

In some embodiments, server device 210 and server data storage device 212 may be a single computing device residing in a single data center. In other embodiments, server device 210 and server data storage device 212 may include multiple computing devices in a data center, or even multiple computing devices in multiple data centers, where the data centers are located in diverse geographic locations. For example, FIG. 2 depicts each of server device 210 and server data storage device 212 potentially residing in a different physical location.

Figure 3B:
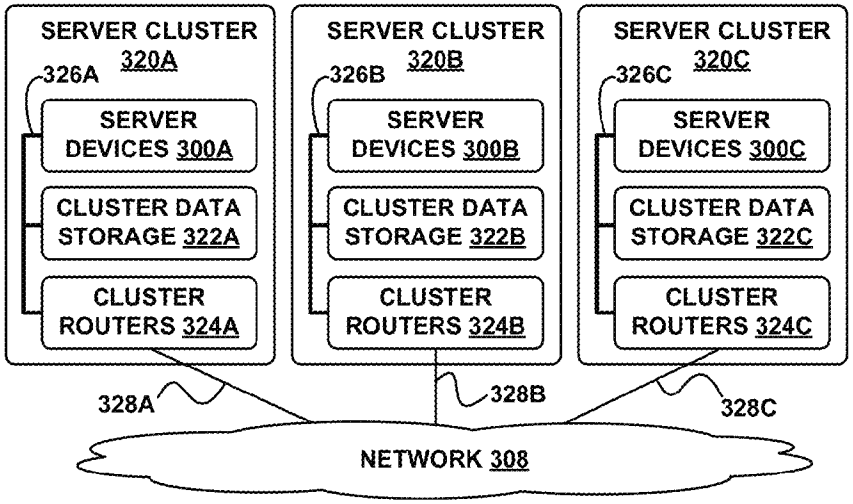
FIG. 3B depicts a cloud-based server system, in accordance with an example embodiment.

FIG. 3B depicts an example of a cloud-based server cluster. In FIG. 3B, functions of server device 210 and server data storage device 212 may be distributed among three server clusters 320A, 320B, and 320C. Server cluster 320A may include one or more server devices 300A, cluster data storage 322A, and cluster routers 324A connected by a local cluster network 326A. Similarly, server cluster 320B may include one or more server devices 300B, cluster data storage 322B, and cluster routers 324B connected by a local cluster network 326B. Likewise, server cluster 320C may include one or more server devices 300C, cluster data storage 322C, and cluster routers 324C connected by a local cluster network 326C. Server clusters 320A, 320B, and 320C may communicate with network 308 via communication links 328A, 328B, and 328C, respectively.

In some embodiments, each of the server clusters 320A, 320B, and 320C may have an equal number of server devices, an equal number of cluster data storages, and an equal number of cluster routers. In other embodiments, however, some or all of the server clusters 320A, 320B, and 320C may have different numbers of server devices, different numbers of cluster data storages, and/or different numbers of cluster routers. The number of server devices, cluster data storages, and cluster routers in each server cluster may depend on the computing task(s) and/or applications assigned to each server cluster.

In the server cluster 320A, for example, server devices 300A can be configured to perform various computing tasks of a server, such as server device 210. In one embodiment, these computing tasks can be distributed among one or more of server devices 300A. Server devices 300B and 300C in server clusters 320B and 320C may be configured the same or similarly to server devices 300A in server cluster 320A. On the other hand, in some embodiments, server devices 300A, 300B, and 300C each may be configured to perform different functions. For example, server devices 300A may be configured to perform one or more functions of server device 210, and server devices 300B and server device 300C may be configured to perform functions of one or more other server devices. Similarly, the functions of server data storage device 212 can be dedicated to a single server cluster, or spread across multiple server clusters.

Cluster data storages 322A, 322B, and 322C of the server clusters 320A, 320B, and 320C, respectively, may be data storage arrays that include disk array controllers configured to manage read and write access to groups of hard disk drives. The disk array controllers, alone or in conjunction with their respective server devices, may also be configured to manage backup or redundant copies of the data stored in cluster data storages to protect against disk drive failures or other types of failures that prevent one or more server devices from accessing one or more cluster data storages.

Similar to the manner in which the functions of server device 210 and server data storage device 212 can be distributed across server clusters 320A, 320B, and 320C, various active portions and/or backup/redundant portions of these components can be distributed across cluster data storages 322A, 322B, and 322C. For example, some cluster data storages 322A, 322B, and 322C may be configured to store backup versions of data stored in other cluster data storages 322A, 322B, and 322C.

Cluster routers 324A, 324B, and 324C in server clusters 320A, 320B, and 320C, respectively, may include networking equipment configured to provide internal and external communications for the server clusters. For example, cluster routers 324A in server cluster 320A may include one or more packet-switching and/or routing devices configured to provide (i) network communications between server devices 300A and cluster data storage 322A via cluster network 326A, and/or (ii) network communications between the server cluster 320A and other devices via communication link 328A to network 308. Cluster routers 324B and 324C may include network equipment similar to cluster routers 324A, and cluster routers 324B and 324C may perform networking functions for server clusters 320B and 320C that cluster routers 324A perform for server cluster 320A.

Additionally, the configuration of cluster routers 324A, 324B, and 324C can be based at least in part on the data communication requirements of the server devices and cluster storage arrays, the data communications capabilities of the network equipment in the cluster routers 324A, 324B, and 324C, the latency and throughput of the local cluster networks 326A, 326B, 326C, the latency, throughput, and cost of the wide area network connections 328A, 328B, and 328C, and/or other factors that may contribute to the cost, speed, fault-tolerance, resiliency, efficiency and/or other design goals of the system architecture.

c. Example Client Device

Figure 4:
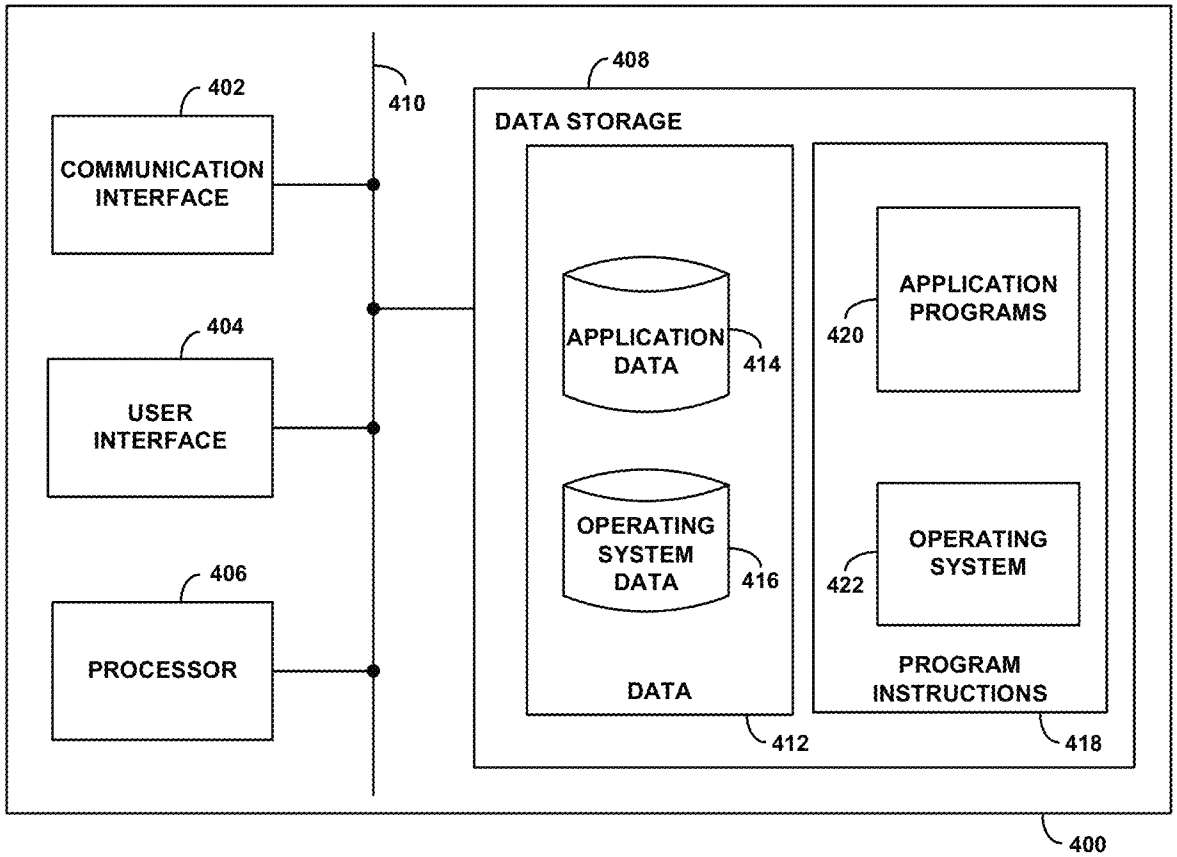
FIG. 4 depicts a block diagram of a client device, in accordance with an example embodiment.

FIG. 4 is a simplified block diagram showing some of the components of an example client device 400. By way of example and without limitation, client device 400 may be or include a "plain old telephone system" (POTS) telephone, a cellular mobile telephone, a still camera, a video camera, a fax machine, an answering machine, a computer (such as a desktop, notebook, or tablet computer), a personal digital assistant, a wearable computing device, a home automation component, a digital video recorder (DVR), a digital TV, a remote control, or some other type of device equipped with one or more wireless or wired communication interfaces.

As shown in FIG. 4, client device 400 may include a communication interface 402, a user interface 404, a processor 406, and data storage 408, all of which may be communicatively linked together by a system bus, network, or other connection mechanism 410.

Communication interface 402 functions to allow client device 400 to communicate, using analog or digital modulation, with other devices, access networks, and/or transport networks. Thus, communication interface 402 may facilitate circuit-switched and/or packet-switched communication, such as POTS communication and/or IP or other packetized communication. For instance, communication interface 402 may include a chipset and antenna arranged for wireless communication with a radio access network or an access point. Also, communication interface 402 may take the form of a wireline interface, such as an Ethernet, Token Ring, or USB port. Communication interface 402 may also take the form of a wireless interface, such as a Wifi, BLUETOOTH®, global positioning system (GPS), or wide-area wireless interface (e.g., WiMAX or LTE). However, other forms of physical layer interfaces and other types of standard or proprietary communication protocols may be used over communication interface 402. Furthermore, communication interface 402 may comprise multiple physical communication interfaces (e.g., a Wifi interface, a BLUETOOTH® interface, and a wide-area wireless interface).

User interface 404 may function to allow client device 400 to interact with a human or non-human user, such as to receive input from a user and to provide output to the user. Thus, user interface 404 may include input components such as a keypad, keyboard, touch-sensitive or presence-sensitive panel, computer mouse, trackball, joystick, microphone, still camera and/or video camera. User interface 404 may also include one or more output components such as a display screen (which, for example, may be combined with a touch-sensitive panel), CRT, LCD, LED, a display using DLP technology, printer, light bulb, and/or other similar devices, now known or later developed. User interface 404 may also be configured to generate audible output(s), via a speaker, speaker jack, audio output port, audio output device, earphones, and/or other similar devices, now known or later developed. In some embodiments, user interface 404 may include software, circuitry, or another form of logic that can transmit data to and/or receive data from external user input/output devices. Additionally or alternatively, client device 400 may support remote access from another device, via communication interface 402 or via another physical interface (not shown).

Processor 406 may comprise one or more general purpose processors (e.g., microprocessors) and/or one or more special purpose processors (e.g., DSPs, GPUs, FPUs, network processors, or ASICs). Data storage 408 may include one or more volatile and/or non-volatile storage components, such as magnetic, optical, flash, or organic storage, and may be integrated in whole or in part with processor 406. Data storage 408 may include removable and/or non-removable components.

In general, processor 406 may be capable of executing program instructions 418 (e.g., compiled or non-compiled program logic and/or machine code) stored in data storage 408 to carry out the various functions described herein. Data storage 408 may include a non-transitory computer-readable medium, having stored thereon program instructions that, upon execution by client device 400, cause client device 400 to carry out any of the methods, processes, or functions disclosed in this specification and/or the accompanying drawings. The execution of program instructions 418 by processor 406 may result in processor 406 using data 412.

By way of example, program instructions 418 may include an operating system 422 (e.g., an operating system kernel, device driver(s), and/or other modules) and one or more application programs 420 (e.g., address book, email, web browsing, social networking, and/or gaming applications) installed on client device 400. Similarly, data 412 may include operating system data 416 and application data 414. Operating system data 416 may be accessible primarily to operating system 422, and application data 414 may be accessible primarily to one or more of application programs 420. Application data 414 may be arranged in a file system that is visible to or hidden from a user of client device 400.

Application programs 420 may communicate with operating system 412 through one or more application programming interfaces (APIs). These APIs may facilitate, for instance, application programs 420 reading and/or writing application data 414, transmitting or receiving information via communication interface 402, receiving or displaying information on user interface 404, and so on.

In some vernaculars, application programs 420 may be referred to as "apps" for short. Additionally, application programs 420 may be downloadable to client device 400 through one or more online application stores or application markets. However, application programs can also be installed on client device 400 in other ways, such as via a web browser or through a physical interface (e.g., a USB port) on client device 400.

4. Example System and Operation a. Example Text-to-Speech System

A TTS synthesis system (or more generally, a speech synthesis system) may operate by receiving an input text string, processing the text string into a symbolic representation of the phonetic and linguistic content of the text string, generating a sequence of speech features corresponding to the symbolic representation, and providing the speech features as input to a speech synthesizer in order to produce a spoken rendering of the input text string. The symbolic representation of the phonetic and linguistic content of the text string may take the form of a sequence of labels, each label identifying a phonetic speech unit, such as a phoneme, and further identifying or encoding linguistic and/or syntactic context, temporal parameters, and other information for specifying how to render the symbolically-represented sounds as meaningful speech in a given language. While the term "phonetic transcription" is sometimes used to refer to such a symbolic representation of text, the term "enriched transcription" introduced above will instead be used herein, in order to signify inclusion of extra-phonetic content, such as linguistic and/or syntactic context and temporal parameters, represented in the sequence of "labels."

The enriched transcription provides a symbolic representation of the phonetic and linguistic content of the text string as rendered speech, and can be represented as a sequence of phonetic speech units identified according to labels, which could further identify or encode linguistic and/or syntactic context, temporal parameters, and other information for specifying how to render the symbolically-represented sounds as meaningful speech in a given language. As discussed above, the phonetic speech units could be phonemes. A phoneme may be considered to be the smallest segment of speech of given language that encompasses a meaningful contrast with other speech segments of the given language. Thus, a word typically includes one or more phonemes. For purposes of simplicity, phonemes may be thought of as utterances of letters, although this is not a perfect analogy, as some phonemes may present multiple letters. As an example, the phonemic spelling for the American English pronunciation of the word "cat" is /k/ /ae/ /t/, and consists of the phonemes /k/, /ae/, and /t/. Another example is the phonemic spelling for the word "dog" is /d/ /aw/ /g/, consisting of the phonemes /d/, /aw/, and /g/. Different phonemic alphabets exist, and other phonemic representations are possible. Common phonemic alphabets for American English contain about 40 distinct phonemes. Other languages may be described by different phonemic alphabets containing different phonemes.

The phonetic properties of a phoneme in an utterance can depend on, or be influenced by, the context in which it is (or is intended to be) spoken. For example, a "triphone" is a triplet of phonemes in which the spoken rendering of a given phoneme is shaped by a temporally-preceding phoneme, referred to as the "left context," and a temporally-subsequent phoneme, referred to as the "right context." Thus, the ordering of the phonemes of English-language triphones corresponds to the direction in which English is read. Other phoneme contexts, such as quinphones, may be considered as well.

Speech features represent acoustic properties of speech as parameters, and in the context of speech synthesis, may be used for driving generation of a synthesized waveform corresponding to an output speech signal. Generally, features for speech synthesis account for three major components of speech signals, namely spectral envelopes that resemble the effect of the vocal tract, excitation that simulates the glottal source, and prosody that describes pitch contour ("melody") and tempo (rhythm). In practice, features may be represented in multidimensional feature vectors that correspond to one or more temporal frames. One of the basic operations of a TTS synthesis system is to map an enriched transcription (e.g., a sequence of labels) to an appropriate sequence of feature vectors.

In the context of speech recognition, features may be extracted from a speech signal (e.g., a voice recording) in a process that typically involves sampling and quantizing an input speech utterance within sequential temporal frames, and performing spectral analysis of the data in the frames to derive a vector of features associated with each frame. Each feature vector can thus be viewed as providing a snapshot of the temporal evolution of the speech utterance.

By way of example, the features may include Mel Filter Cepstral (MFC) coefficients. MFC coefficients may represent the short-term power spectrum of a portion of an input utterance, and may be based on, for example, a linear cosine transform of a log power spectrum on a nonlinear Mel scale of frequency. (A Mel scale may be a scale of pitches subjectively perceived by listeners to be about equally distant from one another, even though the actual frequencies of these pitches are not equally distant from one another.)

In some embodiments, a feature vector may include MFC coefficients, first-order cepstral coefficient derivatives, and second-order cepstral coefficient derivatives. For example, the feature vector may contain 13 coefficients, 13 first-order derivatives ("delta"), and 13 second-order derivatives ("delta-delta"), therefore having a length of 39. However, feature vectors may use different combinations of features in other possible embodiments. As another example, feature vectors could include Perceptual Linear Predictive (PLP) coefficients, Relative Spectral (RASTA) coefficients, Filter-bank log-energy coefficients, or some combination thereof. Each feature vector may be thought of as including a quantified characterization of the acoustic content of a corresponding temporal frame of the utterance (or more generally of an audio input signal).

In accordance with example embodiments of HMM-based speech synthesis, a sequence of labels corresponding to enriched transcription of the input text may be treated as observed data, and a sequence of HMMs and HMM states is computed so as to maximize a joint probability of generating the observed enriched transcription. The labels of the enriched transcription sequence may identify phonemes, triphones, and/or other phonetic speech units. In some HMM-based techniques, phonemes and/or triphones are represented by HMMs as having three states corresponding to three temporal phases, namely beginning, middle, and end. Other HMMs with a different number of states per phoneme (or triphone, for example) could be used as well. In addition, the enriched transcription may also include additional information about the input text string, such as time or duration models for the phonetic speech units, linguistic context, and other indicators that may characterize how the output speech should sound, for example.

In accordance with example embodiments, speech features corresponding to HMMs and HMM states may be represented by multivariate PDFs for jointly modeling the different features that make up the feature vectors. In particular, multivariate Gaussian PDFs can be used to compute probabilities of a given state emitting or generating multiple dimensions of features from a given state of the model. Each dimension of a given multivariate Gaussian PDF could thus correspond to different feature. It is also possible to model a feature along a given dimension with more than one Gaussian PDF in that dimension. In such an approach, the feature is said to be modeled by a mixture of Gaussians, referred to a "Gaussian mixture model" or "GMM." The sequence of features generated by the most probable sequence of HMMs and HMM states can be converted to speech by a speech synthesizer, for example.

Figure 5:
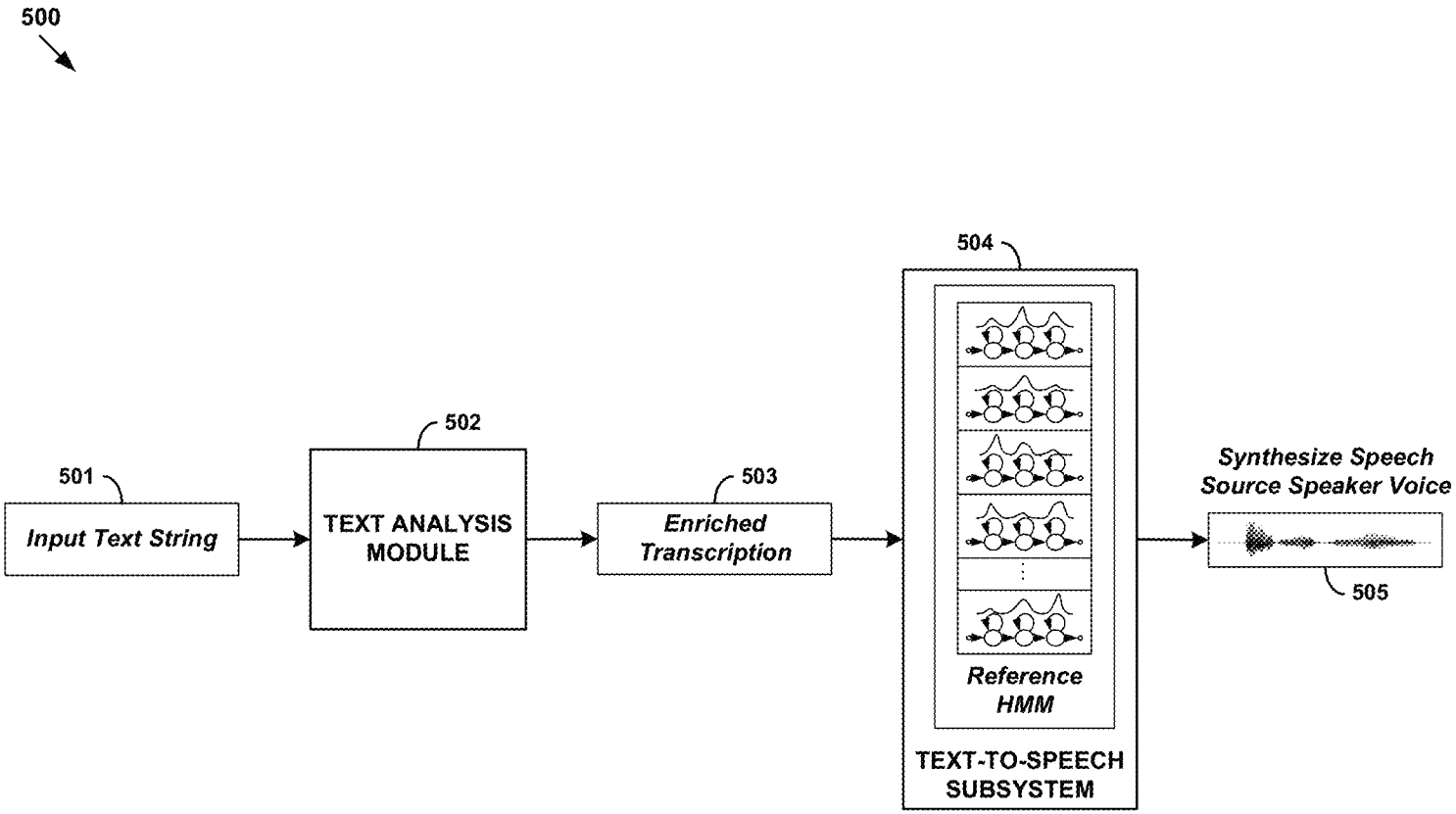
FIG. 5 depicts a simplified block diagram of an example text-to-speech system, in accordance with an example embodiment.

FIG. 5 depicts a simplified block diagram of an example HMM-based text-to-speech (TTS) synthesis system 500, in accordance with an example embodiment. In addition to functional components, FIG. 5 also shows selected example inputs, outputs, and intermediate products of example operation. The functional components of the TTS synthesis system 500 include a text analysis module 502 for converting input text 501 into an enriched transcription 503, and a TTS subsystem 504, including a reference HMM, for generating synthesized speech 505 from the enriched transcription 503. These functional components could be implemented as machine-language instructions in a centralized and/or distributed fashion on one or more computing platforms or systems, such as those described above. The machine-language instructions could be stored in one or another form of a tangible, non-transitory computer-readable medium (or other article of manufacture), such as magnetic or optical disk, or the like, and made available to processing elements of the system as part of a manufacturing procedure, configuration procedure, and/or execution start-up procedure, for example.

It should be noted that the discussion in this section, and the accompanying figures, are presented for purposes of example. Other TTS system arrangements, including different components, different relationships between the components, and/or different processing, may be possible. For example, in an alternative embodiment, a TTS system could use a machine-learning model, such a neural network, for generating speech features at run-time based on learned (trained) associations between known labels and known parameterized speech.

In accordance with example embodiments, the text analysis module 502 may receive an input text string 501 (or other form of text-based input) and generate an enriched transcription 503 as output. The input text string 501 could be a text message, email, chat input, or other text-based communication, for example. As described above, the enriched transcription could correspond to a sequence of labels that identify speech units, including context information.

As shown, the TTS subsystem 504 may employ HMM-based speech synthesis to generate feature vectors corresponding to the enriched transcription 503. This is illustrated in FIG. 5 by a symbolic depiction of a reference HMM in the TTS subsystem 504. The reference HMM is represented by a configuration of speech-unit HMMs, each corresponding to a phonetic speech unit of a reference language. The phonetic units could be phonemes or triphones, for example. Each speech-unit HMM is drawn as a set of circles, each representing a state of the speech unit, and arrows connecting the circles, each arrow representing a state transition. A circular arrow at each state represents a self-transition. Above each circle is a symbolic representation of a PDF. In the HMM methodology, the PDF specifies the probability that a given state will "emit" or generate speech features corresponding to the speech unit modeled by the state. The depiction in the figure of three states per speech-unit HMM is consistent with some HMM techniques that model three states for each speech unit. However, HMM techniques using different numbers of states per speech units may be employed as well, and the illustrative use of three states in FIG. 5 (as well as in other figures herein) is not intended to be limiting with respect to example embodiments described herein. Further details of an example TTS synthesis system are described below.

In the example of FIG. 5, the TTS subsystem 504 outputs synthesized speech 505 in a voice of a reference speaker. The reference speaker could be a speaker used to train the reference HMM.

In further accordance with example embodiments, the HMMs of a HMM-based TTS synthesis system may be trained by tuning the PDF parameters, using a database of text recorded speech and corresponding known text strings.

Figure 6:
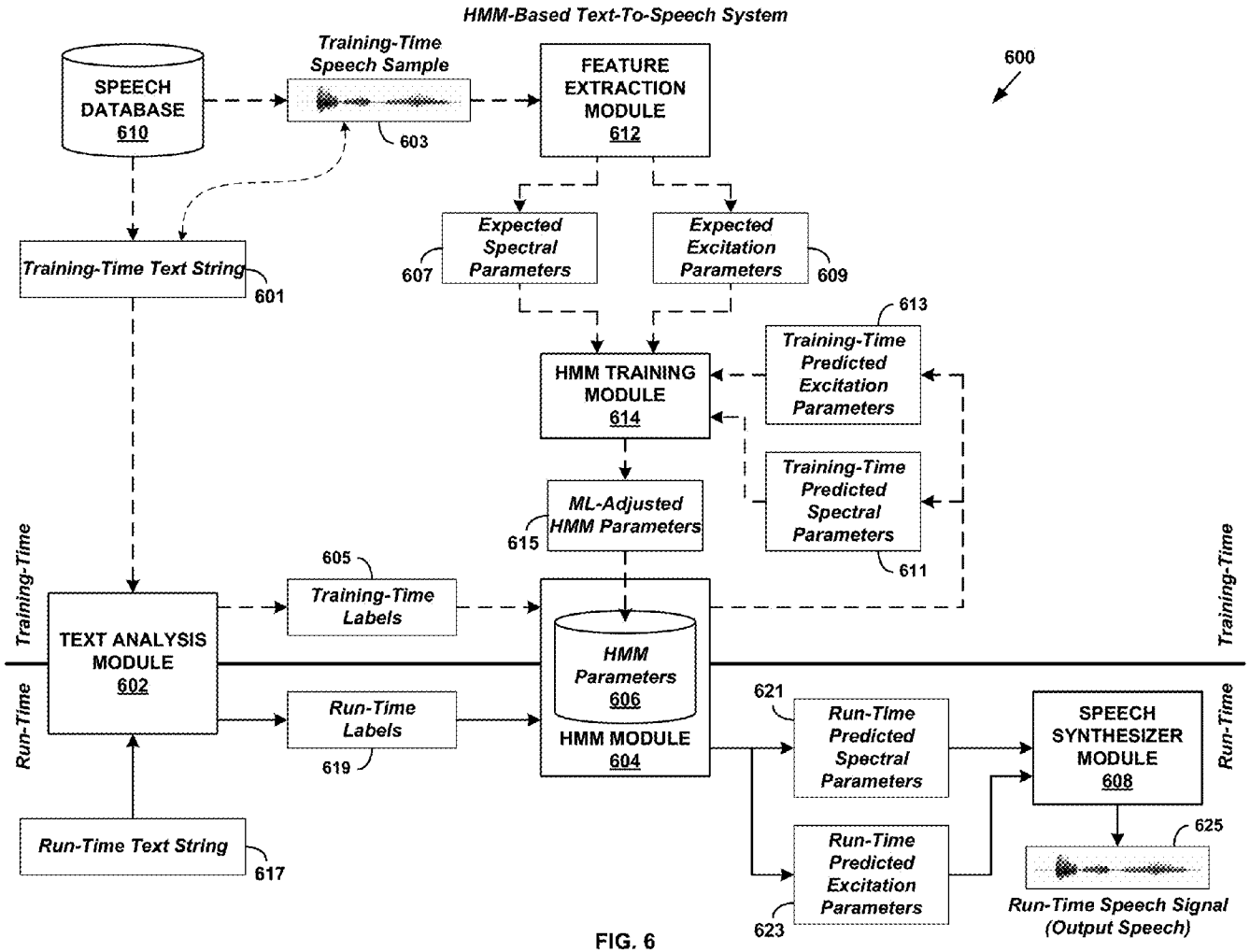
FIG. 6 is a block diagram depicting additional details of an example hidden-Markov-mode-based text-to-speech speech system, in accordance with an example embodiment.

FIG. 6 is a block diagram depicting additional details of an example HMM-based text-to-speech speech system, in accordance with an example embodiment. As with the illustration in FIG. 5, FIG. 6 also displays functional components and selected example inputs, outputs, and intermediate products of example operation. The functional components of the speech synthesis system 600 include a text analysis module 602, a HMM module 604 that includes HMM parameters 606, a speech synthesizer module 608, a speech database 610, a feature extraction module 612, and a HMM training module 614. These functional components could be implemented as machine-language instructions in a centralized and/or distributed fashion on one or more computing platforms or systems, such as those described above. The machine-language instructions could be stored in one or another form of a tangible, non-transitory computer-readable medium (or other article of manufacture), such as magnetic or optical disk, or the like, and made available to processing elements of the system as part of a manufacturing procedure, configuration procedure, and/or execution start-up procedure, for example.

For purposes of illustration, FIG. 6 is depicted in a way that represents two operational modes: training-time and run-time. A thick, horizontal line marks a conceptual boundary between these two modes, with "Training-Time" labeling a portion of FIG. 6 above the line, and "Run-Time" labeling a portion below the line. As a visual cue, various arrows in the figure signifying information and/or processing flow and/or transmission are shown as dashed lines in the "Training-Time" portion of the figure, and as solid lines in the "Run-Time" portion.

During training, a training-time text string 601 from the speech database 610 may be input to the text analysis module 602, which then generates training-time labels 605 (an enriched transcription of the training-time text string 601). Each training-time label could be made up of a phonetic label identifying a phonetic speech unit (e.g., a phoneme), context information (e.g., one or more left-context and right-context phoneme labels, physical speech production characteristics, linguistic context, etc.), and timing information, such as a duration, relative timing position, and/or phonetic state model.

The training-time labels 605 are then input to the HMM module 604, which models training-time predicted spectral parameters 611 and training-time predicted excitation parameters 613. These may be considered speech features that are generated by the HMM module according to state transition probabilities and state emission probabilities that make up (at least in part) the HMM parameters. The training-time predicted spectral parameters 611 and training-time predicted excitation parameters 613 are then input to the HMM training module 614, as shown.

In further accordance with example embodiments, during training a training-time speech signal 603 from the speech database 610 is input to the feature extraction module 612, which processes the input signal to generate expected spectral parameters 607 and expected excitation parameters 609. The training-time speech signal 603 is predetermined to correspond to the training-time text string 601; this is signified by a wavy, dashed double arrow between the training-time speech signal 603 and the training-time text string 601. In practice, the training-time speech signal 601 could be a speech recording of a speaker reading the training-time text string 603. More specifically, the corpus of training data in the speech database 610 could include numerous recordings of a reference speaker reading numerous text strings. The expected spectral parameters 607 and expected excitation parameters 609 may be considered known parameters, since they are derived from a known speech signal.

During training time, the expected spectral parameters 607 and expected excitation parameters 609 are provided as input to the HMM training module 614. By comparing the training-time predicted spectral parameters 611 and training-time predicted excitation parameters 613 with the expected spectral parameters 607 and expected excitation parameters 609, the HMM training module 614 can determine how to adjust the HMM parameters 606 so as to achieve closest or optimal agreement between the predicted results and the known results. While this conceptual illustration of HMM training may appear suggestive of a feedback loop for error reduction, the procedure could entail a maximum likelihood (ML) adjustment of the HMM parameters. This is indicated by the return of ML-adjusted HMM parameters 615 from the HMM training module 614 to the HMM parameters 606. In practice, the training procedure may involve many iterations over many different speech samples and corresponding text strings in order to cover all (or most) of the phonetic speech units of the language of the TTS speech synthesis system 600 with sufficient data to determine accurate parameter values.

During run-time operation, illustrated in the lower portion of FIG. 6 (below thick horizontal line), a run-time text string 617 is input to the text analysis module 602, which then generates run-time labels 619 (an enriched transcription of the run-time text string 617). The form of the run-time labels 619 may be the same as that for the training-time labels 605. The run-time labels 619 are then input to the HMM module 604, which generates run-time predicted spectral parameters 621 and run-time predicted excitation parameters 623, again according to the HMM-based technique.

The run-time predicted spectral parameters 621 and run-time predicted excitation parameters 623 can generated in pairs, each pair corresponding to a predicted pair of feature vectors for generating a temporal frame of waveform data.

In accordance with example embodiments, the run-time predicted spectral parameters 621 and run-time predicted excitation parameters 623 may next be input to the speech synthesizer module 608, which may then synthesize a run-time speech signal 625. As an example, speech synthesize could include a vocoder that can translate the acoustic features of the input into an output waveform suitable for playout on an audio output device, and/or for analysis by a signal measuring device or element. Such a device or element could be based on signal measuring hardware and/or machine language instructions that implement an analysis algorithm. With sufficient prior training, the run-time speech signal 625 may have a high likelihood of being an accurate speech rendering of the run-time text string 617.

In an alternative embodiment, a neural network, such as a "feed-forward" neural network, can be used for mapping enriched transcriptions to parameterized speech. A neural network can be implemented as machine-language instructions, such as a software and/or firmware program, in a centralized and/or distributed fashion on one or more computing platforms or systems, for example. In algorithmic terms, a neural network can be described as having one or more "layers," each including a set of "nodes." Each node can correspond to a mathematical function, such as a scalar weighting function, having adjustable parameters, and by which can be computed a scalar output of one or more inputs. All of the nodes may be the same scalar function, differing only according to possibly different parameter values, for example. By way of example, the mathematical function could take the form of a sigmoid function. The output of each node in a given layer can be connected to the inputs of one or more nodes of the next "forward" layer. The nodes of a first, "input layer" can receive input data at their respective inputs, and the nodes of a last, "output layer" can deliver output data from their respective outputs. There can be one or more "hidden layers" between the input and output layers.

In the context of a TTS system, for example, the input layer could receive one or more enriched transcriptions, and the output layer could deliver feature vectors or other form of parameterized speech. By appropriately adjusting the respective parameter values of the functions of the nodes during a training process, the neural network can learn how to later accurately generate and output run-time predicted feature vectors in response to enriched transcriptions received as input at run time.

Figure 7:
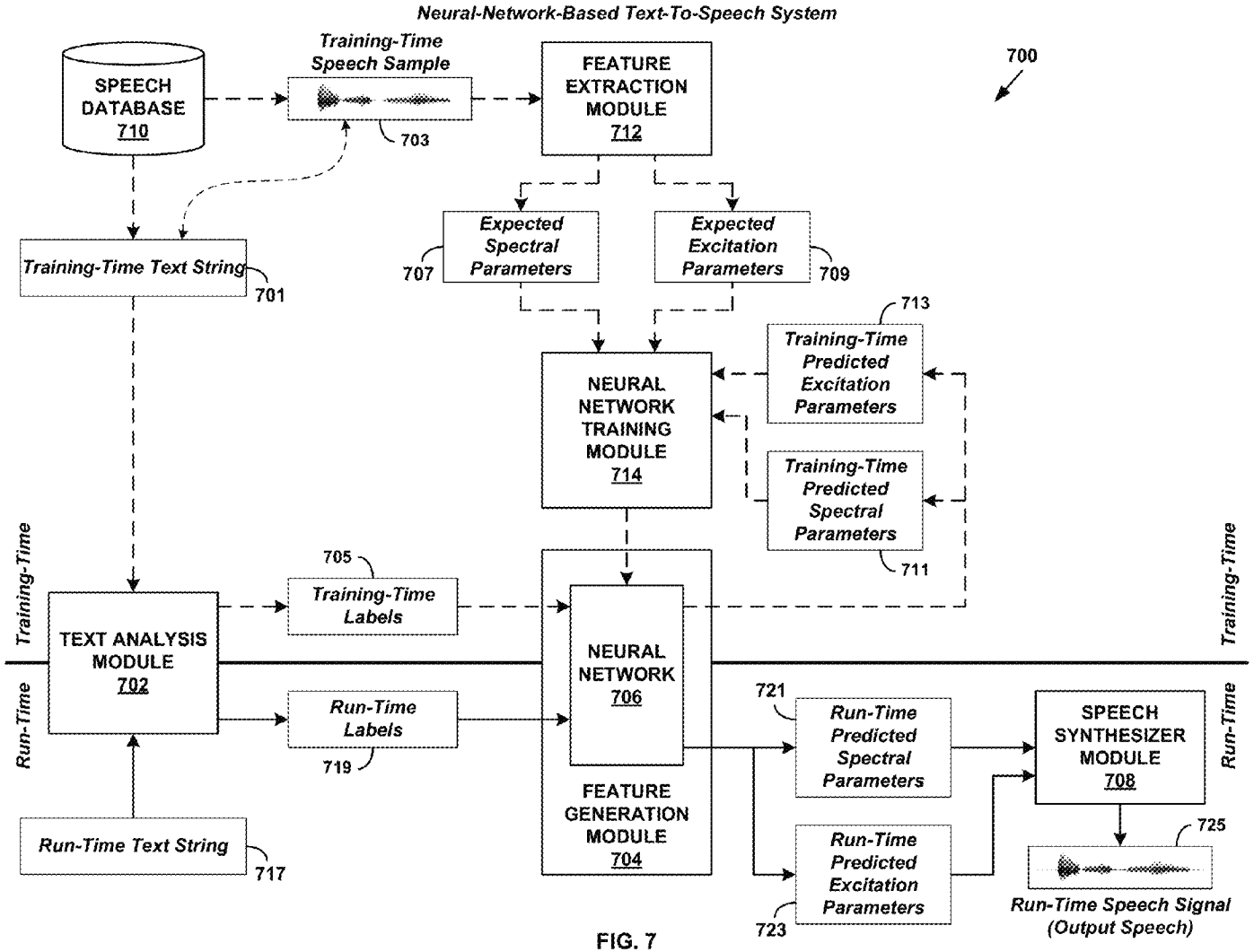
FIG. 7 is a block diagram depicting an example neural-network-based text-to-speech speech system, in accordance with an example embodiment

FIG. 7 is a block diagram of an example TTS system 700, in accordance with an alternative example embodiment in which mapping between enriched transcriptions and parameterized speech is achieved by a neural network (NN). As shown, functional components of the TTS system 700 include a text analysis module 702, feature generation module 704 that includes a neural network 706, a speech synthesizer module 708, a speech database 710, a feature extraction module 712, and a neural network training module 714. These functional components could be implemented as machine-language instructions in a centralized and/or distributed fashion on one or more computing platforms or systems, such as those described above. The machine-language instructions could be stored in one or another form of a tangible, non-transitory computer-readable medium (or other article of manufacture), such as magnetic or optical disk, or the like, and made available to processing elements of the system as part of a manufacturing procedure, configuration procedure, and/or execution start-up procedure, for example.

As with the TTS system illustrated in FIG. 6, a training-time operational mode and a run-time operational mode are represented in FIG. 7. Again, a thick, horizontal line marks a conceptual boundary between these two modes, with "Training-Time" labeled above the line, and "Run-Time" labeled below. Data/processing flow is represented in dashed lines in the "Training-Time" portion of the figure, and in solid lines in the "Run-Time" portion.

Operation of the TTS system 700 in the two modes is largely similar to that described for the HMM-based TTS system 600 in FIG. 6, except for certain aspects related to the neural network. During training, a training-time text string 701 from the speech database 710 may be input to the text analysis module 702, which then generates training-time labels 705 (an enriched transcription of the training-time text string 701). The training-time labels 705 are then input to the feature generation module 704, which models training-time predicted spectral parameters 711 and training-time predicted excitation parameters 713. These correspond to speech features generated by the neural network 706. The training-time predicted spectral parameters 711 and training-time predicted excitation parameters 713 are then input to the neural network training module 714, as shown.

Also during training time a training-time speech signal 703 from the speech database 710 is input to the feature extraction module 712, which processes the input signal to generate expected spectral parameters 707 and expected excitation parameters 709. A correspondence between the training-time speech signal 703 and the training-time text string 701 is signified by a wavy, dashed double arrow between the two. The expected spectral parameters 707 and expected excitation parameters 709 are provided as input to the neural network training module 714. By comparing the training-time predicted spectral parameters 711 and training-time predicted excitation parameters 713 with the expected spectral parameters 707 and expected excitation parameters 709, the neural network training module 714 can determine how to adjust the neural network 706 so as to achieve closest or optimal agreement between the predicted results and the known results. For example, the parameters of the scalar function in each node of the neural network 706 can be iteratively adjusted to achieve the consistent and accurate agreement between expected and training-time parameters.

During run-time operation, a run-time text string 717 can be input to the text analysis module 702, which then generates run-time labels 719. The run-time labels 719 are then input to the feature generation module 704, which generates run-time predicted spectral parameters 721 and run-time predicted excitation parameters 723, according to the trained NN-based operation. The run-time predicted spectral parameters 721 and run-time predicted excitation parameters 723 can be input to the speech synthesizer module 708, which may then synthesize a run-time speech signal 725.

In FIGS. 6 and 7, feature extraction for generating expected spectral and excitation parameters, and text analysis for generating training-time labels, are represented as training-time operations. However, these operations need not necessarily be carried out during training time. More particularly, they can be carried prior to training time, and their outputs stored in a training database, which can subsequently be accessed during training time to achieve the same purpose at that depicted in FIGS. 6 and 7. In accordance with example embodiments, a training database can be created during a separate phase or operational mode from training, and can further be conditioned prior to training to improve the quality of the data, and hence improve the accuracy and effectiveness of the subsequent training.

Figure 8:
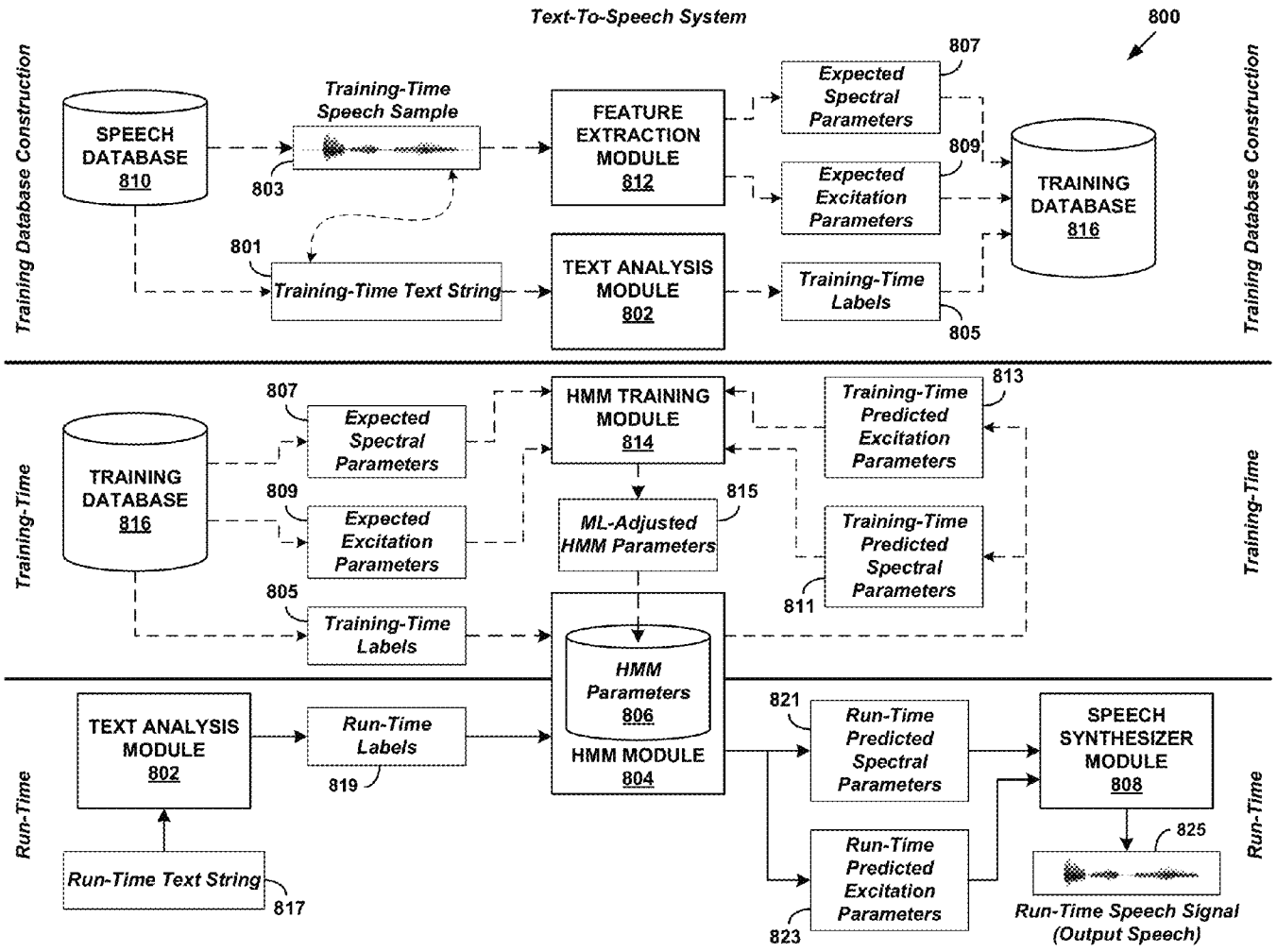
FIG. 8 is a block diagram depicting an alternative version of an example HMM-based text-to-speech speech system, in accordance with an example embodiment.

FIG. 8 is a block diagram of a HMM-based TTS system 800 in which construction of a training database is carried out separately from both training and run-time operation. The functional components of the TTS system 800 include a text analysis module 802, a HMM module 804 that includes HMM parameters 806, a speech synthesizer module 808, a speech database 810, a feature extraction module 812, a HMM training module 814, and a training database 816. These functional components could be implemented as machine-language instructions in a centralized and/or distributed fashion on one or more computing platforms or systems, such as those described above. The machine-language instructions could be stored in one or another form of a tangible, non-transitory computer-readable medium (or other article of manufacture), such as magnetic or optical disk, or the like, and made available to processing elements of the system as part of a manufacturing procedure, configuration procedure, and/or execution start-up procedure, for example.

In FIG. 8, three operational modes, descriptively labeled "Training Database Construction," "Training-Time," and "Run-Time," are represented in three panels separated by two thick, horizontal lines. Data/processing flow is represented in dashed lines in the "Training Database Construction" panel (top) and the "Training-Time" panel (middle), and in solid lines in the "Run-Time" panel (bottom). Some of the functional components of the TTS system 800 have operational roles in more than one mode, and are represented more than once in FIG. 8.

During training database construction, a training-time text string 801 from the speech database 810 may be input to the text analysis module 802, which then generates training-time labels 805 (an enriched transcription of the training-time text string 801). Also during training database construction a training-time speech signal 803 from the speech database 810 is input to the feature extraction module 812, which processes the input signal to generate expected spectral parameters 807 and expected excitation parameters 809. A correspondence between the training-time speech signal 803 and the training-time text string 801 is signified by a wavy, dashed double arrow between the two. The expected spectral parameters 807 and expected excitation parameters 809, and the training-time labels 805 are all then stored in the training database 816, together with a mapping or association between the parameterize speech and the labels. The training database 816 can then be accessed during training time to train the TTS system 800.

During training time, the training-time labels 805 can be retrieved from the training database 816 and input to the HMM module 804, which models training-time predicted spectral parameters 811 and training-time predicted excitation parameters 813. The training-time predicted spectral parameters 811 and training-time predicted excitation parameters 813 are then input to the HMM training module 814, as shown. Also during training time, the expected spectral parameters 807 and expected excitation parameters 809 associated with the training time labels 805 can be retrieved from the training database 816 and provided as input to the HMM training module 814. By comparing the training-time predicted spectral parameters 811 and training-time predicted excitation parameters 813 with the expected spectral parameters 807 and expected excitation parameters 809, the HMM training module 814 can determine how to adjust the HMM parameters 806 so as to achieve closest or optimal agreement between the predicted results and the known results.

During run-time operation, a run-time text string 817 is input to the text analysis module 802, which then generates run-time labels 819. The run-time labels 819 are then input to the HMM module 804, which generates run-time predicted spectral parameters 821 and run-time predicted excitation parameters 823. In accordance with example embodiments, the run-time predicted spectral parameters 821 and run-time predicted excitation parameters 823 can then input to the speech synthesizer module 808, which can synthesize a run-time speech signal 825.

Note that while FIG. 8 illustrates three separate operational modes for a HMM-based TTS system 800, a similar configuration of three modes—training database construction, training-time, and run-time—can be achieved with a NN-based TTS system, such as the one illustrated in FIG. 7. Explicit description of such a configuration is omitted here for the sake of brevity.

In accordance with example embodiments, a training database constructed in a separate operation from actual training, such as the training database 816, can be conditioned prior to use in training so as to improve the quality of the training data and thereby improve the accuracy and effectiveness of the subsequent training More particularly, conditioning a training database can entail replacing feature vectors (e.g., the expected spectral parameters 807 and expected excitation parameters 809) with ones from a known, high-quality database, using an optimal matching technique. Such a conditioning procedure is described below.

b. Building a TTS Speech Database from Multiple Speech Sources

The accuracy of a TTS system—e.g., how accurately the TTS system maps text to intended speech (e.g., as written)—and the quality of a TTS system—e.g., how natural or "good" the synthesize voice sounds—can depend, at least in part, on the quality and quantity of the speech samples (e.g., speech utterances) used for training the TTS system. More particularly, the quality of record samples can affect the accuracy with which speech utterances can be decomposed into feature vectors used for training And the quality of recorded speech samples, together with the quantity, can affect the consistency with which mapping numerous recorded instances of the same intended speech sounds (e.g., acoustic renderings of speech units, such as phonemes) can yield similar characteristic parametric representations of those sounds (e.g. feature vectors). This can, in turn, be a factor in how well the TTS system can be trained to reproduce the parametric representations for speech synthesis at run-time.

Considering, by way of example, the TTS system 800 in FIG. 8, speech samples used for training can be recorded and stored in the speech database 810, together with their associated text strings. The quality and effectiveness of training a text-to-speech system, such as the TTS system 800, can therefore be tied to the quality and quantity of the speech samples in the speech database 810, since these are among the factors can determine the quality of the feature vectors used in training (e.g., the expected spectral parameters 807 and expected excitation parameters 809 in the example of the TTS system 800).

One conventional approach to assembling a speech database of a large number (quantity) of high-quality recordings is to invest significant effort into acquiring a large number of speech samples from a skilled (trained) speaker reading from standard or canonical text sources, and recording the readings under controlled, relatively noise-free conditions. While this approach can yield good results for training a TTS system, it can pose practical challenges and involve large expense in terms of time and cost in some circumstances. For example, the availability of, and/or demand for, trained readers and controlled recording facilities might be relatively less common among speakers of certain long-tail languages than among large populations of widely-spoken languages. This is just one example of a circumstance that might be an impediment to a conventional approach to building a speech database for TTS training.

By contrast, it may be relatively easy and/or inexpensive to acquire a large number of samples of multiple different speakers of a given language recorded under diverse, and, to some extent, uncontrolled conditions (e.g., noise, quality of recording equipment, etc.). Such recordings might be acquired on an ad hoc basis, such as "man-on-the-street" or impromptu recording sessions, for example. Additionally or alternatively, a wide variety of recording collections might be publically and freely available on the Internet or other public networks. While the total quantity of recordings represented in all (or even just some) such recording collections can be quite large, the potential inconsistencies of the recordings—both in terms of speaker skill (e.g., voice clarity, voice quality, etc.) and recording conditions—can diminish the quality of a speech database that includes these recordings. Consequently, the accuracy and quality of TTS system trained using such a speech database can suffer.

In accordance with example embodiments, a high-quality training database, such as training database 816, can be constructed from numerous individual recording collections of speech samples of different speakers of the same common language made under diverse recording conditions by applying a conditioning technique to feature vectors derived from the recorded samples. More specifically, the conditioning technique entails replacing feature vectors derived from recorded speech samples of multiple different speakers of the same common language with optimally-matched speaker vectors derived from recorded speech samples of a reference speaker of a reference language in a quality-controlled speech database, referred to herein as a "reference speech database." Identification of the optimally-matched speaker vectors is achieved using a technique that matches speaker vectors of different speakers under a transform that compensates for differences in speech between the different speakers.

The matching technique, referred to as "matching under transform" or "MUT," enables parameterized representations of speech sounds derived from speech of a reference speaker to be optimally matched to parameterized representations of speech sounds derived from speech of one or more other speakers. When the speech of the reference speaker is of higher quality than that of the one or more other speakers, the optimally-matched parameterized representations can serve as higher-quality replacements of the parameterized representations that were derived from the speech of the one or more other speakers.

In accordance with example embodiments, the matching-and-replacing technique using MUT can be applied separately to each of multiple speech databases acquired from different speakers to create separate sets of replaced (conditioned) feature vectors. The separate sets of replaced feature vectors can then be aggregated into a single conditioned training database, referred to as an aggregated conditioned training database. Carrying out the matching-and-replacing technique separately on each of multiple speech databases can eliminate the effect of inconsistencies between the different multiple speech databases, thereby achieving the best MUT results for each of the multiple speech databases before all the replaced feature vectors are aggregated.

The reference language of the reference speaker need not be the same as the common language of the multiple speakers, although this is not excluded by example embodiments. Rather, the reference language and the common language may be lexically related. For example, they may represent different but related branches (or descendants) of a single language family. Other relationships based on some form of similarity or commonality between the reference language and the common language are possible as well.

For purposes of convenience in the discussion herein, the common language of the multiple speakers will be referred to as a "colloquial language." As noted earlier, the use of the qualitative descriptor "colloquial" is meant to signify a generalized impact of a relatively diminished emphasis on speaker consistency, speech quality, and/or control of recording conditions in the process of obtaining the speech databases of the multiple speakers. The qualitative descriptor "colloquial" will also be adopted to refer to the multiple speakers, the speech databases obtained from their recordings, as well as aspects and elements related to processing of their speech.

In accordance with example embodiments, a respective colloquial speech database can be acquired from each of multiple colloquial speakers of a colloquial language. Each colloquial speech database can contain a respective plurality of colloquial speech utterances (speech samples) each corresponding to a text string (or other form of written text). For purposes of discussion, the number of colloquial speech databases will be taken to be K, each obtained from one of K colloquial speakers. For example, each of the K colloquial speech databases might represent one of K different recording sessions with one of the K colloquial speakers.

Referring again to FIG. 8, each of the K colloquial speech databases can be of a form represented by the speech database 810. In accordance with example embodiments, each colloquial speech database can be processed to construct a corresponding, respective colloquial training database. For example, the process described for constructing the training database 816 can be used to construct K colloquial training databases. Each colloquial training database can be of a form represented by the training database 816, each containing a respective plurality of colloquial-speaker vectors, and each colloquial-speaker vector having an associated enriched transcription. For example, still keeping with the example illustrated in FIG. 8, each colloquial-speaker vector can correspond to a vector of expected spectral parameters 807 and expected excitation parameters 809; the associated transcription can be the associate training-time labels 805.

The number of colloquial-speaker vectors (and associated enriched transcriptions) need not be the same in each of the colloquial training databases. For identification purposes, the K colloquial training databases can be indexed by k, k=1, . . . , K. To signify the possibly different number of colloquial-speaker vectors in each colloquial training database, the colloquial-speaker vectors in each colloquial training database can be indexed by $j_k$, $j_k=1, \ldots, J_k$, where $J_k$ is the number of colloquial-speaker vectors in the kth colloquial training database, and again, k=1, . . . , K. The total number N of colloquial-speaker vectors in all K colloquial training database is then given by $N=\Sigma_{k=1}^{K}J_k$.

Also in accordance with example embodiments, a reference speech database can be acquired from a reference speaker of a reference language. The reference speech database can contain a plurality of reference speech utterances (speech samples), each corresponding to a text string (or other form or written text). Furthermore, the reference speech database can be processed to construct a corresponding, reference training database. For example, the process described for constructing the training database 816 can also be used to construct the reference training database. The reference training database can be of a form represented by the training database 816, containing a plurality of reference-speaker vectors, and each reference-speaker vector having an associated enriched transcription. For example, each reference-speaker vector can correspond to a vector of expected spectral parameters 807 and expected excitation parameters 809; the associated transcription can be the associate training-time labels 805.

For purposes of discussion, the number of reference-speaker vectors in the reference training database will be taken to be M. The individual reference-speaker vectors can be indexed by i, i=1, . . . , M. Note that in general, M can be different any or all of $J_k$, k=1, . . . , K. In practice, for circumstance in which the reference speech database represents a high-quality speech database of a large quantity of reference speech samples, and each of the K colloquial speech databases might be represent relatively small speech databases, it might be the case that $M>J_k$, k=1, . . . , K. This need not be the case, however. Furthermore, even for $M>J_k$, k=1, . . . , K, it may be that M<N or M≈N. Again, example embodiments do not exclude other relative sizes of M, N, and $J_k$.

In accordance with example embodiments, for each of the $J_k$ colloquial-speaker vectors in the kth colloquial training database, MUT can be used to identify an optimally-matched reference-speaker vector from among the M reference-speaker vectors in the reference training database. Once the identification is made, the colloquial-speaker of each match can be replaced in the kth colloquial training database with the identified optimally-matched reference-speaker vector. As described in more detail below, MUT operates jointly over the ensemble of all the $J_k$ colloquial-speaker vectors in the kth colloquial training database and the ensemble of all M reference-speaker vectors in the reference training database. Thus, all of the identifications are made for the colloquial-speaker vectors in the kth colloquial training database in a joint operation before each colloquial-speaker vectors in the kth colloquial training database is replaced by its identified optimal match.

In further accordance with example embodiments, for each colloquial-speaker vector replaced by its optimally-matched reference-speaker vector in the manner described above, the enriched transcription associated with the colloquial-speaker vector is retained. Thus, the respective enriched transcription that represents a symbolic phonetic description of each colloquial-speaker vector comes to be associated with a replaced speaker vector. Put another way, the parametric representation of speech associated with each enriched transcription can be considered as being updated with a new parametric representation of that speech obtained from parametric representations in the reference training database using MUT.

In further accordance with example embodiments, the joint MUT operation is carried out separately for each different colloquial training database. That is, the joint MUT operation is carried out separately over each of the k=1, . . . , K colloquial training database. However, each joint MUT operation matches the $J_k$ colloquial-speaker vectors in the kth colloquial training database against the same M reference-speaker vectors in the reference training database. By carrying out the MUT separately in this manner, any possible inconsistencies between the different colloquial training databases does not enter into any of the joint operations.

Note that the replacement of colloquial-speaker vectors in kth colloquial training database the can be carried out after the MUT identifications are made for the kth colloquial training database, or after the MUT identifications are made for all K of the colloquial training databases. Either approach can be accommodated by appropriately keeping track of the MUT identifications made in each of the K joint MUT operations.

In accordance with example embodiments, the replaced speaker vectors in all the K colloquial training databases can be aggregated into an aggregated conditioned training database. By doing so, a high-quality training database containing all the N total replaced speaker vectors can be constructed. The aggregated conditioned training database can then be used to train a TTS system. The N replaced speaker vectors can be added to the aggregated conditioned training database all at once, following completion first of the replacing $J_k$ (k=1, . . . , K) colloquial-speaker vectors in all the K colloquial training databases before aggregating them. Alternatively, the N replaced speaker vectors can be aggregated iteratively, by adding the replaced $J_k$ colloquial-speaker vectors of the kth colloquial training database before carrying out MUT and replacement of the $J_{k+1}$ colloquial-speaker vectors in the k+1st colloquial training database, and so on, for example.

Figure 9:
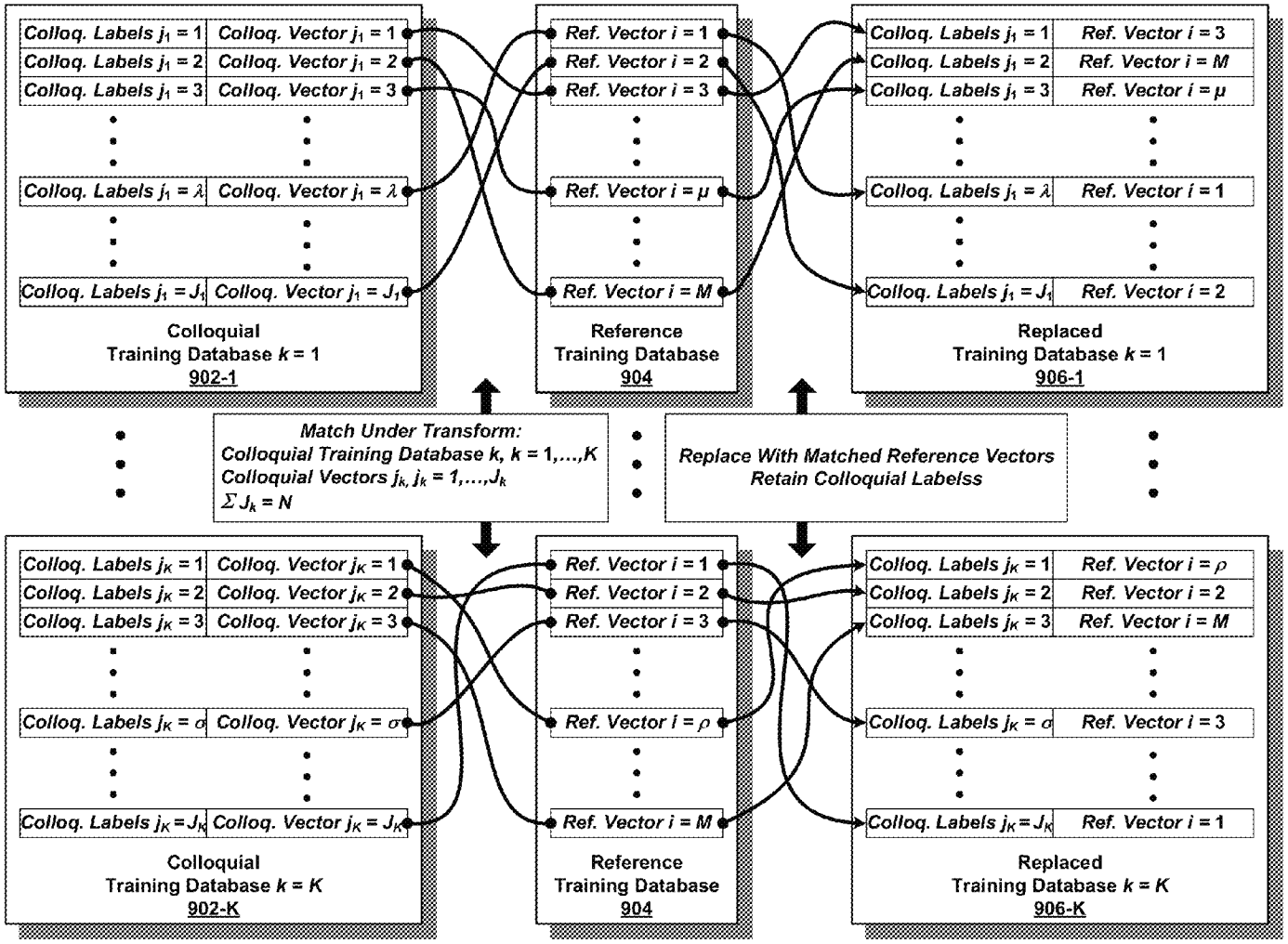
FIG. 9 is an example conceptual illustration of speaker vector replacement, in accordance with an example embodiment.

FIG. 9 is an example conceptual illustration of the matching-and-replacement operations, in accordance with example embodiments. For purposes of illustration, FIG. 9 depicts (top and bottom left of FIG. 9) MUT and replacement only for the colloquial-speaker vectors $j_1$=1, . . . , $J_1$ in the k=1 colloquial training database 901-1, and for the colloquial-speaker vectors $j_k$=1, . . . , $J_K$ in the k=K colloquial training database 901-K. Vertical ellipses between the colloquial training database 901-1 and the colloquial training database 901-K represent the other k=2, . . . , K−1 colloquial training databases, each containing their respective $J_k$ (k=2, . . . , K−1) colloquial-speaker vectors. Vertical ellipses between the colloquial-speaker vectors within the k=1 colloquial training database 902-1 and the k=K colloquial training database 901-K represent other possible colloquial-speaker vectors of the two colloquial training databases, but not explicitly shown in the figure.

Each respective colloquial-speaker vector in FIG. 9 is also depicted next to its associated enriched transcription, which carries the same index as the respective colloquial-speaker vector. For the sake of brevity in the figure, the colloquial-speaker vectors are simply labeled "Colloq. Vector" and the associated enriched transcriptions are simply labeled "Colloq. Labels."

The top and bottom middle portion of FIG. 9 depicts the i=1, . . . , M reference-speaker vectors of the reference training database 904. In accordance with example embodiments, the same reference training database 904 is used in MUT and replacement for each of the colloquial training databases. This is indicated by the duplicate depiction of the reference training database 904 in the top and bottom of the figure. The vertical ellipses in the middle portion of FIG. 9 represent repeated use of the reference training database 904 for the other MUT and replacement operations. For the sake of brevity in the figure, the reference-speaker vectors are simply labeled "Ref. Vector." Enriched transcriptions that can be associated with the reference-speaker vectors are omitted from the illustration, since MUT only operates on the parameterized speech representations (e.g., feature vectors). Vertical ellipses between the reference-speaker vectors within the reference training database 904 represent other possible reference-speaker vectors of the reference training databases (not explicitly shown in the figure).

FIG. 9 also depicts (top and bottom right of FIG. 9) the replaced speaker vectors only for the replaced speaker vectors $j_1$=1, . . . , $J_1$ in the k=1 replaced training database 906-1, and for the replaced speaker vectors $j_k$=1, . . . , $J_K$ in the k=K replaced training database 906-K. Vertical ellipses between the replaced training database 906-1 and the replaced training database 906-K represent the other k=2, . . . , K−1 replaced training databases, each containing their respective $J_k$ (k=2, . . . , K−1) replaced speaker vectors.

In accordance with example embodiments, each colloquial-speaker vector is replaced by an optimally-matched reference-speaker vector. Thus, each respective replaced speaker vector in FIG. 9 is labeled "Ref. Vector" since it comes from the reference training database. Also in accordance with example embodiment, the respective enriched transcription associated with each replaced speaker vector is retained. This is also indicated in FIG. 9 by the reuse of the "Colloq. Labels" from the colloquial training databases 902-1, . . . , 902-K.

Example operation of MUT and replacement illustrated in FIG. 9 is represented conceptually by black curved lines connecting colloquial-speaker vectors in the colloquial training databases 902-1 and 902-K with reference-speaker vectors in the reference training database 904 at the top and bottom of FIG. 9; and by black curved arrows connecting the (matched) reference-speaker vectors in the reference training database 904 at the top and bottom of FIG. 9 with the replaced speaker vectors in the replaced training databases 906-1 and 906-K. By way of example, the colloquial-speaker vector $j_1$=1 is shown to be matched with the reference-speaker vector i=3. Also by way of example, the colloquial-speaker vector $j_1$=2 is shown to be matched with the reference-speaker vector i=M; the colloquial-speaker vector $j_1$=3 is shown to be matched with the reference-speaker vector i=μ; the colloquial-speaker vector $j_1$=λ is shown to be matched with the reference-speaker vector i=1; and the colloquial-speaker vector $j_1$=$J_1$ is shown to be matched with the reference-speaker vector i=2. As mentioned above and described in more detail below, the optimal matching of the individual colloquial-speaker vectors to the reference-speaker vectors is carried out jointly over the ensemble of speaker vectors in both training database. The particular matches represented in this example by the thick curved lines are arbitrary and for purposes of illustration only.

As shown by the black curved arrows, the reference-speaker vectors identified as optimal matches to the colloquial-speaker vectors in the colloquial training database 902-1 the become the replacement speaker vectors in the replaced training database 906-1. Thus, in the illustrated example, the colloquial-speaker vector $j_1$=1 is replaced by the reference-speaker vector i=3. Similarly, the colloquial-speaker vector $j_1$=2 is replaced by the reference-speaker vector i=M; the colloquial-speaker vector $j_1$=3 is replaced by the reference-speaker vector i=μ; the colloquial-speaker vector $j_1$=λ is replaced by the reference-speaker vector i=1; and the colloquial-speaker vector $j_1$=$J_1$ is replaced by the reference-speaker vector i=2. Note that the colloquial labels (enriched transcriptions) are not replaced. The replaced training database 906-1 can thus be obtained from the colloquial training database 902-1 by replacing the colloquial-speaker vectors of the colloquial training database 902-1 with the optimally-matched reference-speaker vectors.

A similar description of MUT and replacement applies to the colloquial training database 902-K. Again by way of example, the colloquial-speaker vector $j_K$=1 is shown to be matched with the reference-speaker vector i=ρ; the colloquial-speaker vector $j_K$=2 is shown to be matched with the reference-speaker vector i=2; the colloquial-speaker vector $j_K$=3 is shown to be matched with the reference-speaker vector i=M; the colloquial-speaker vector $j_K$=σ is shown to be matched with the reference-speaker vector i=3; and the colloquial-speaker vector $j_K$=$J_K$ is shown to be matched with the reference-speaker vector i=1. Once more, the optimal matching of the individual colloquial-speaker vectors to the reference-speaker vectors is carried out jointly over the ensemble of speaker vectors in both training database. However, the optimal matching for the colloquial-speaker vectors in the colloquial training database 902-K is carried out separately from that for the colloquial-speaker vectors in the colloquial training database 902-1. The particular matches represented in this example by the thick curved lines are, once more, arbitrary and for purposes of illustration only.

Again, the black curved arrows indicate the replacement operation. In the illustrated example, the reference-speaker vectors identified as optimal matches to the colloquial-speaker vectors in the colloquial training database 902-K become the replacement speaker vectors in the replaced training database 906-K. Thus, in the illustrated example, the colloquial-speaker vector $j_K=1$ is replaced by the reference-speaker vector $i=\rho$; the colloquial-speaker vector $j_K=2$ is replaced by the reference-speaker vector i=2; the colloquial-speaker vector $j_K=3$ is replaced by the reference-speaker vector i=M; the colloquial-speaker vector $j_K=\sigma$ is replaced by the reference-speaker vector i=3; and the colloquial-speaker vector $j_K=J_K$ is replaced by the reference-speaker vector i=1. Again, the colloquial labels (enriched transcriptions) are not replaced. The replaced training database 906-K can thus be obtained from the colloquial training database 902-K by replacing the colloquial-speaker vectors of the colloquial training database 902-K with the optimally-matched reference-speaker vectors.

Figure 10:
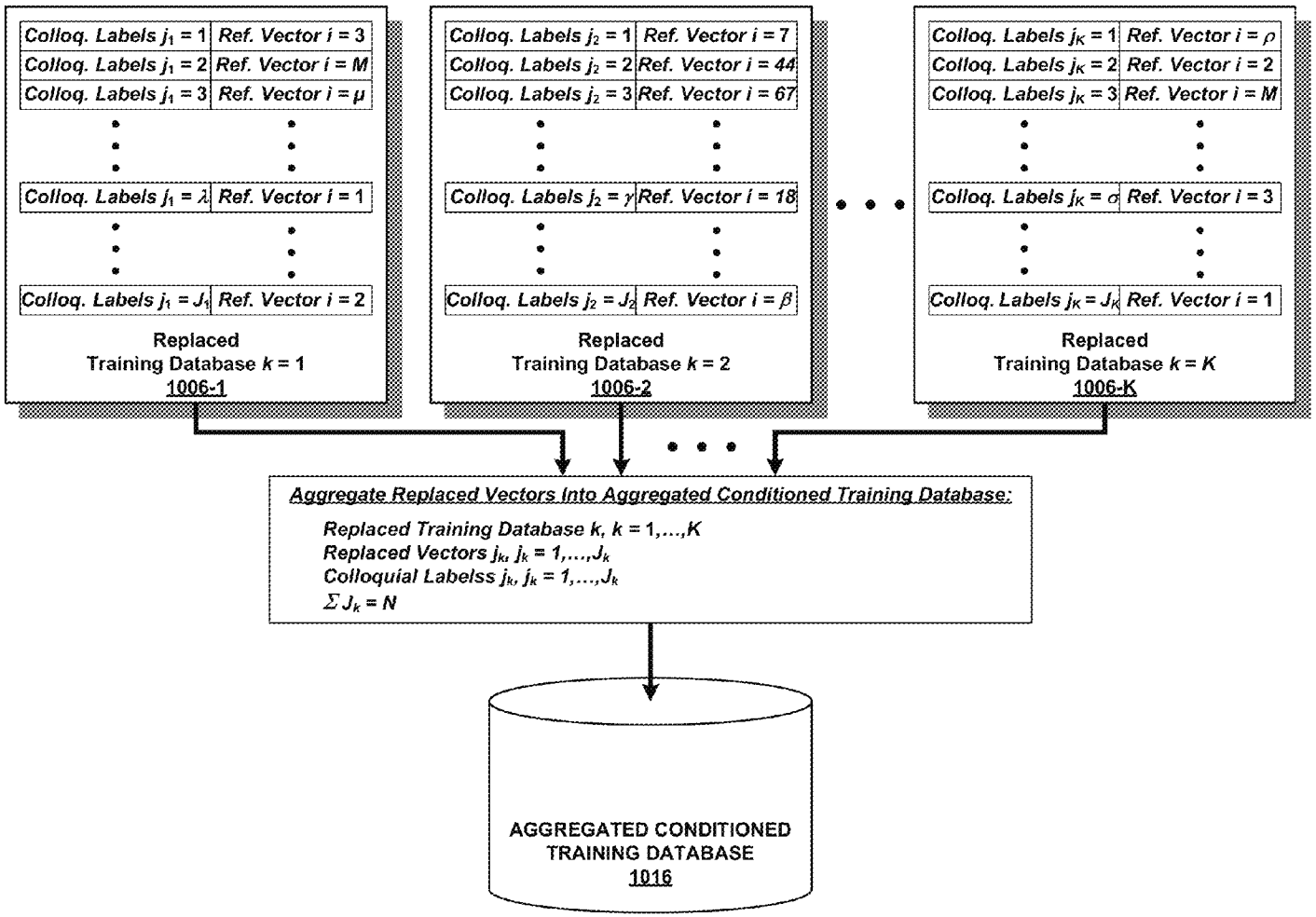
FIG. 10 is an example conceptual illustration of construction of an aggregated conditioned training database, in accordance with an example embodiment.

FIG. 10 is an example conceptual illustration of construction of an aggregated conditioned training database, in accordance with an example embodiment. The example illustration includes a replaced training database 1006-1 (corresponding to the replaced training database 906-1 in FIG. 9), a replaced training database 1006-2, and a replaced training database 1006-K (corresponding to the replaced training database 906-K in FIG. 9). The horizontal ellipses between the replaced training databases 1006-2 and 1006-K represent replaced training databases for k=3, . . . , K−1. The three replaced training database, plus the ones represented only by horizontal ellipses, are aggregated in an aggregated conditioned training database 1016, as shown. The operations that achieve conditioning thus entail MUT and replacement. The aggregated conditioned training database 1016 can be used to train a TTS system, such as the HMM-based TTS system 800 depicted in FIG. 8.

Figure 11:
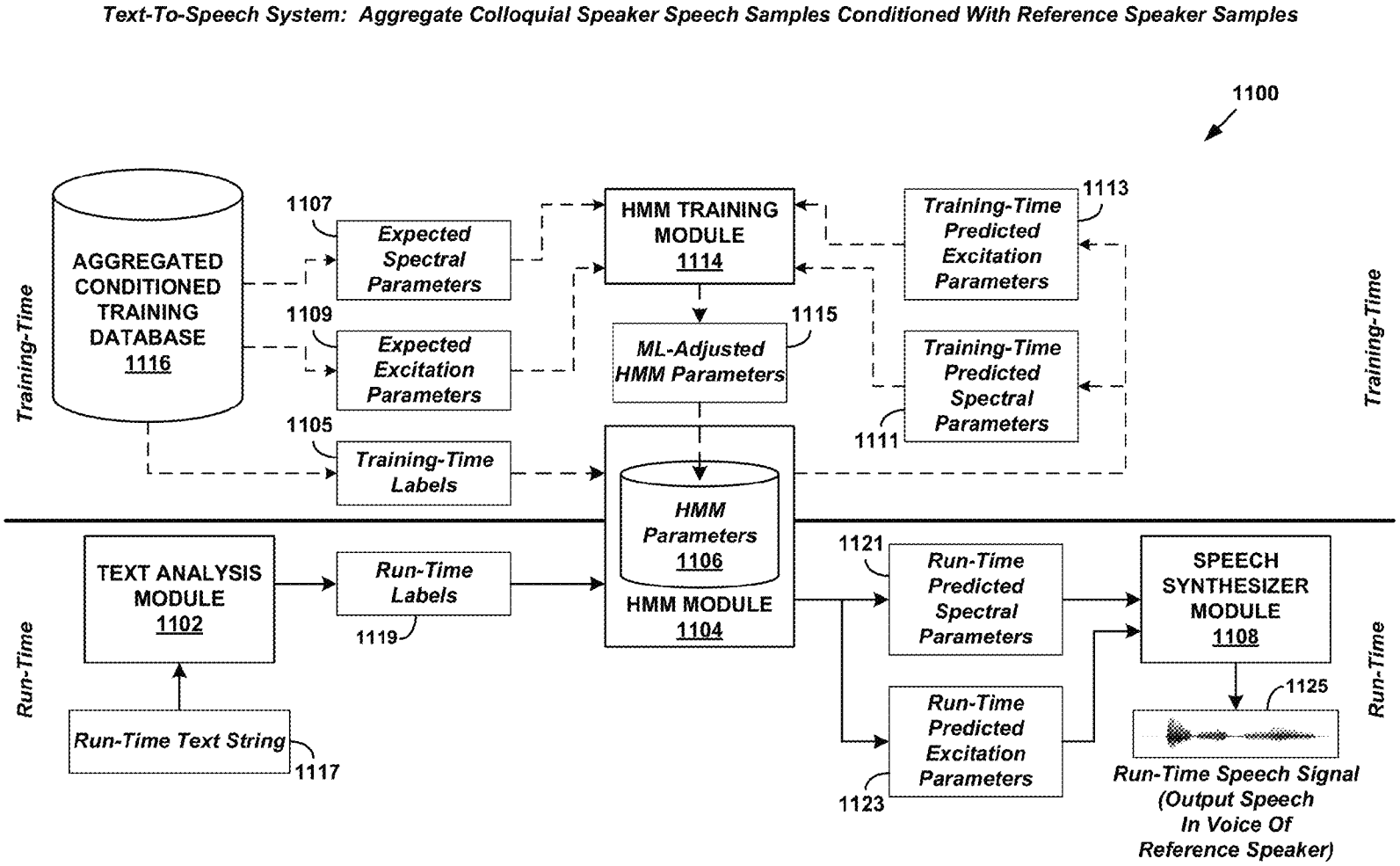
FIG. 11 is a block diagram depicting training of an example HMM-based text-to-speech speech system using an aggregated conditioned training database, in accordance with an example embodiment.

Training a TTS system with an aggregated conditioned training database is illustrated in FIG. 11, which shows a HMM-based TTS system 1100. The functional components of the TTS system 1110 include a text analysis module 1102, a HMM module 1104 that includes HMM parameters 1106, a speech synthesizer module 1108, a HMM training module 1114, and an aggregated conditioned training database 1116. These functional components could be implemented as machine-language instructions in a centralized and/or distributed fashion on one or more computing platforms or systems, such as those described above. The machine-language instructions could be stored in one or another form of a tangible, non-transitory computer-readable medium (or other article of manufacture), such as magnetic or optical disk, or the like, and made available to processing elements of the system as part of a manufacturing procedure, configuration procedure, and/or execution start-up procedure, for example.

In accordance with example embodiments, the aggregated conditioned training database 1116 can be constructed as described above for the aggregated conditioned training database 1016.

Two operational modes are represented in FIG. 11, descriptively labeled "Training-Time," and "Run-Time," and separated by a thick, horizontal line. Data/processing flow is represented in dashed lines in the "Training-Time" panel (top), and in solid lines in the "Run-Time" panel (bottom). During training time, the training-time labels 1105 can be retrieved from the aggregated conditioned training database 1116 and input to the HMM module 1104, which models training-time predicted spectral parameters 1111 and training-time predicted excitation parameters 1113. The training-time predicted spectral parameters 1111 and training-time predicted excitation parameters 1113 are then input to the HMM training module 1114, as shown. Also during training time, the expected spectral parameters 1107 and expected excitation parameters 1109 associated with the training time labels 1105 can be retrieved from the aggregated conditioned training database 1116 and provided as input to the HMM training module 1114. By comparing the training-time predicted spectral parameters 1111 and training-time predicted excitation parameters 1113 with the expected spectral parameters 1107 and expected excitation parameters 1109, the HMM training module 1114 can determine how to adjust the HMM parameters 1106 so as to achieve closest or optimal agreement between the predicted results and the known results.

During run-time operation, a run-time text string 1117 is input to the text analysis module 1102, which then generates run-time labels 1119. The run-time labels 1119 are then input to the HMM module 1104, which generates run-time predicted spectral parameters 1121 and run-time predicted excitation parameters 1123. In accordance with example embodiments, the run-time predicted spectral parameters 1121 and run-time predicted excitation parameters 1123 can then input to the speech synthesizer module 1108, which can synthesize a run-time speech signal 1125. By training the TTS system 1100 with the aggregated conditioned training database 1116, synthesized speech can be made sound like the voice of the reference speaker, even though the initial sources of the training speech samples were the multiple colloquial speakers.

Note that while FIG. 11 illustrates two separate operational modes for a HMM-based TTS system 1100, a similar configuration of two modes—training-time and run-time—can be achieved with a NN-based TTS system, such as the one illustrated in FIG. 7. Explicit description of such a configuration is omitted here for the sake of brevity.

Figure 12:
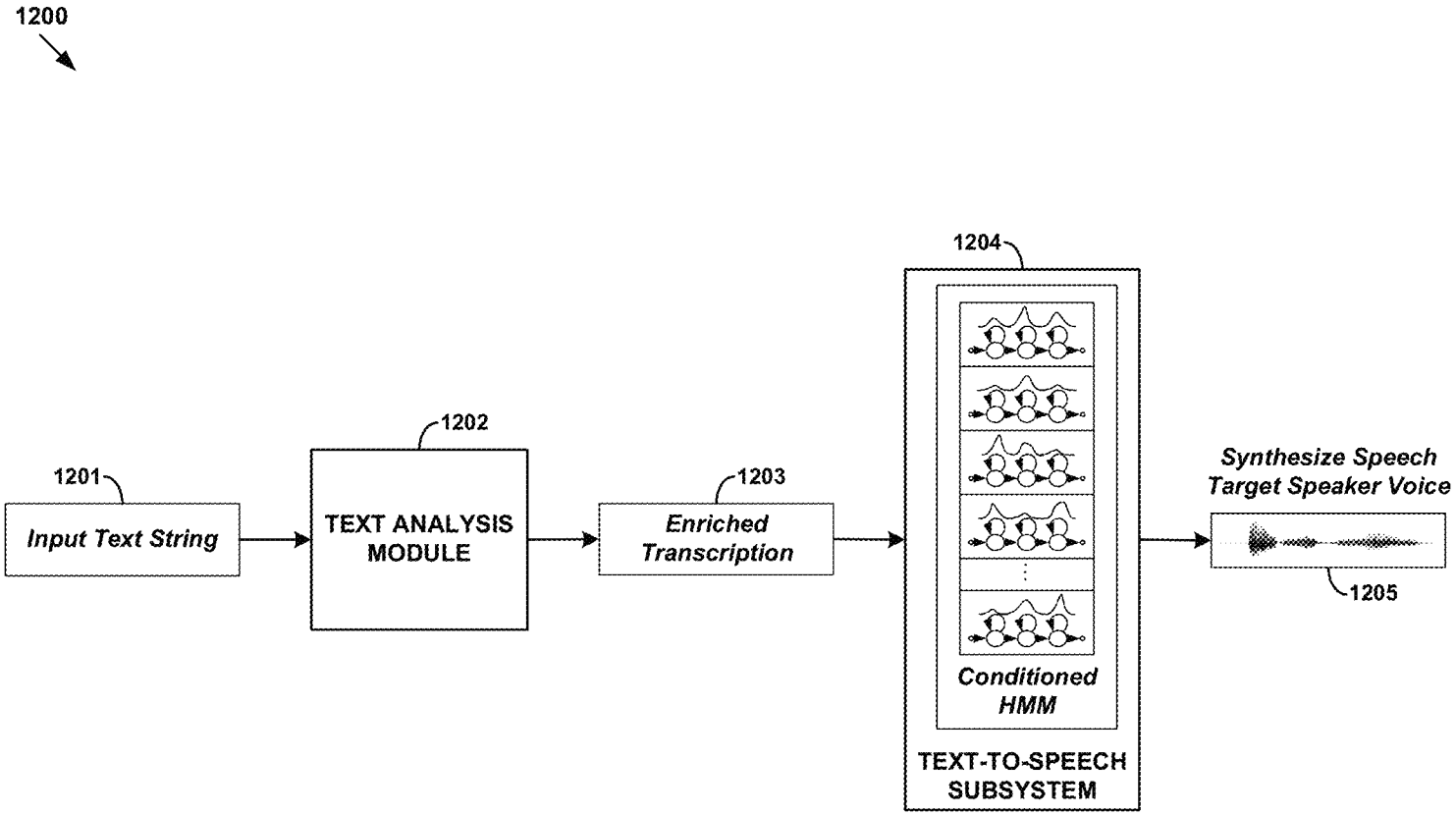
FIG. 12 depicts a simplified block diagram of an example text-to-speech system using a SPSS trained with an aggregated conditioned training database, in accordance with an example embodiment.

FIG. 12 depicts a simplified block diagram of an example HMM-based text-to-speech (TTS) synthesis system 1200, in accordance with an example embodiment. The HMM-based text-to-speech (TTS) synthesis system 1200 is similar to the TTS system 500 shown in FIG. 5, except its HMM has been trained using an aggregated conditioned training database such as the ones described above. More particularly, the PDF parameters of the HMM states can be adjusted during training such as that represented in the top of FIG. 11.

The functional components of the TTS synthesis system 1200 include a text analysis module 1202 for converting input text 1201 into an enriched transcription 1203, and a TTS subsystem 1204, including a conditioned HMM, for generating synthesized speech 1205 from the enriched transcription 1203.

In accordance with example embodiments, the text analysis module 1202 may receive an input text string 1201 (or other form of text-based input) and generate an enriched transcription 1203 as output. The TTS subsystem 1204 may then employ the conditioned HMM to generate feature vectors corresponding to the enriched transcription 1203.

c. Matching Under Transform

In general terms, the replacement of colloquial-speaker vectors with reference-speaker vectors described above is a form of "voice conversion." More particularly, voice conversion is concerned with converting the voice of a source speaker to the voice of a target speaker. For purposes of the discussion herein, the target speaker is designated X, and the source speaker is designated Y. These designations are intended for convenience of discussion, and other designations could be used. In the context of speech modeling (e.g., recognition and/or synthesis), feature analysis of speech samples of speaker X could generate a vector space of speech features, designated X-space. Similarly, feature analysis of speech samples of speaker Y could generate a vector space of speech features, designated Y-space. For example, feature vectors could correspond to parameterizations of spectral envelopes and/or excitation, as discussed above. In general, X-space and Y-space may be different. For example, they could have a different number of vectors and/or different parameters. Further, they could correspond to different languages, be generated using different feature extraction techniques, and so on.

Matching under transform may be considered a technique for matching the X-space and Y-space vectors under a transform that compensates for differences between speakers X and Y. It may be described in algorithmic terms as a computational method, and can be implemented as machine-readable instructions executable by the one or more processors of a computing system, such as a TTS synthesis system. The machine-language instructions could be stored in one or another form of a tangible, non-transitory computer-readable medium (or other article of manufacture), such as magnetic or optical disk, or the like, and made available to processing elements of the system as part of a manufacturing procedure, configuration procedure, and/or execution start-up procedure, for example.

The following discussion describes a mathematical formalism that can be used to convert the voice of the source speaker, represented by Y-space vectors, to the voice of the target speaker, represented by X-space vectors. In the context of the colloquial speakers and the reference speaker described above, each instance of a colloquial speaker can be taken to be the source speaker of the formalism, and the reference speaker can be taken to be the target speaker of the formalism. With this correspondence, the computations implied by the formalism can be viewed as being carried out separately for each colloquial speaker as an instance of source speaker. For purposes of discussion the formalism, and without loss of generality, the terminology of "source," "target," X-space, and Y-space is adopted.

By way of example, X-space may be taken to include N vectors, designated $\vec{x}_n$, n=1, . . . , N. Similarly, Y-space may be taken to include Q vectors, designated $\vec{y}_q$, q=1, . . . , Q. As noted, N and Q may not necessarily be equal, although the possibility that they are is not precluded. In the context of speech modeling, N and Q could correspond to a number of samples from speakers X and Y, respectively.

In accordance with example embodiments, matching under transform (MUT) uses a transformation function $\vec{y}=F(\vec{x})$ to convert X-space vectors to Y-space vectors, and applies a matching-minimization (MM) operation within a deterministic annealing framework to match each Y-space vector with one X-space vector. The transformation function defines a parametric mapping from X-space to Y-space. At the same time, a non-parametric, association mapping from Y-space to X-space may be defined in terms of conditional probabilities. Specifically, for a given X-space vector $\vec{x}_n$ and a given Y-space vector $\vec{y}_q$, an "association probability" $p(\vec{x}_n|\vec{y}_q)$ may be used to specify a probability that $\vec{y}_q$ maps to $\vec{x}_n$. In this way, MUT involves bi-directional mapping between X-space and Y-space: parametric in a "forward direction" (X→Y) via F(•), and non-parametric in the "backward direction" (Y→X) via $p(\vec{x}_n|\vec{y}_q)$.

A goal of MUT is to determine which X-space vectors $\vec{x}_n$ correspond to a Y-space $\vec{y}_q$ vector in the sense that $F(\vec{x})$ is close $\vec{y}_q$ in L2-norm, and under the circumstance that $F(\vec{x})$ and the probabilities $p(\vec{x}_n|\vec{y}_q)$ are not known ahead of time. Rather than searching for every possible mapping between X-space and Y-space vectors, a distortion metric between $\vec{x}_n$ and $\vec{y}_q$ may be defined as:

$$d(\vec{y}_q,\vec{x}_n)=(\vec{y}_q-F(\vec{x}_n))^T W_q(\vec{y}_q-F(\vec{x}_n)) \quad [1]$$

where $W_q$ is a weighting matrix depending on Y-space vector $\vec{y}_q$. Then taking $p(\vec{x}_n|\vec{y}_q)$ to be the joint probability of matching vectors $\vec{y}_q$ and $\vec{x}_n$, an average distortion over all possible vector combinations may be expressed as:

$$D=\Sigma_{n,q}p(\vec{y}_q,\vec{x}_n)d(\vec{y}_q,\vec{x}_n)=\Sigma_q p(\vec{y}_q)\Sigma_n p(\vec{x}_n|\vec{y}_q)d(\vec{y}_q,\vec{x}_n). \quad [2]$$

In the MUT approach, the bi-directional mapping provides a balance between forward and backward mapping, ensuring convergence to a meaningful solution.

Figure 13:
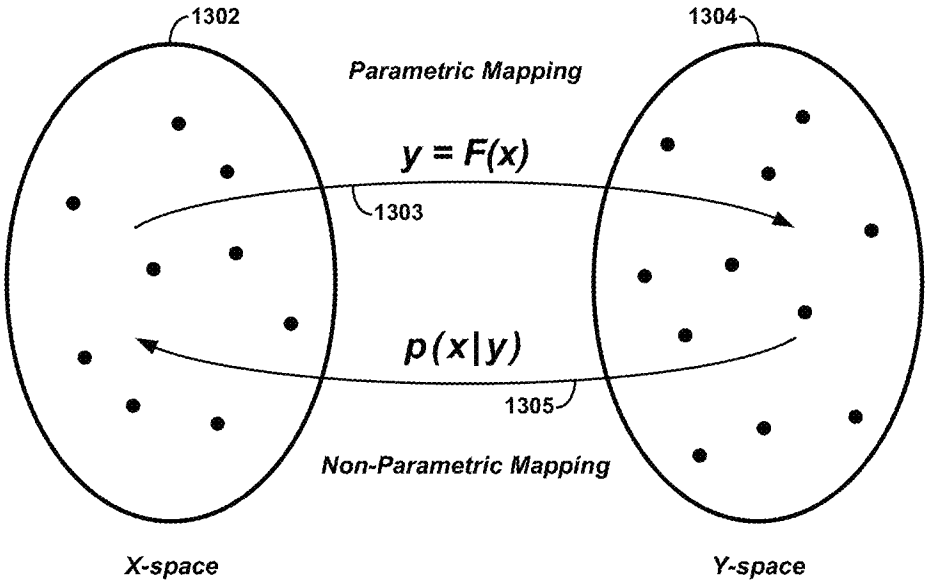
FIG. 13 is a conceptual illustration of parametric and non-parametric mapping between vector spaces, in accordance with an example embodiment.

FIG. 13 is a conceptual illustration of parametric and non-parametric mapping between vector spaces, in accordance with example embodiments. The figure includes an X-space 1302, represented as an oval containing several dots, each dot symbolically representing an X-space vector (e.g., $\vec{x}_n$). Similarly, a Y-space 1304 is represented as an oval containing several dots, each dot symbolically representing an Y-space vector (e.g., $\vec{y}_q$). For purposes of illustration, and by way of example, the two spaces are shown to contain a different number of vectors (dots). An arrow 1303 from X-space to Y-space symbolically represents parametric mapping given by $\vec{y}=F(\vec{x})$. In the opposite direction, an arrow 1305 from Y-space to X-space symbolically represents non-parametric mapping via $p(\vec{x}_n|\vec{y}_q)$.

In accordance with example embodiments, minimizing the average distortion D simultaneously for $F(\vec{x})$ and $p(\vec{x}_n|\vec{y}_q)$ may be achieved using techniques of simulated annealing. Specifically, an uncertainty in probabilistic matching between X-space and Y-space may be accounted for by an "association entropy," which can be expressed as H(Y,X)=H(Y)+H(X|Y). Taking $$p(\vec{y}_q)=\frac{1}{Q}$$

so as to ensure that all Y-space vectors are accounted for equally, it follows that H(Y) is constant. A composite minimization criterion D' may then be defined as:

$$D'=D-\lambda H(X|Y), \quad [3]$$

where the entropy Lagrangian λ corresponds to an annealing temperature.

Minimizing D' with respect to the association probabilities yields the associations. In the general case of λ≠0, the association probabilities may be expressed in the form of a Gibbs distribution and determined in what is referred to algorithmically herein as an "association step." When λ approaches zero, the mapping between Y-space and X-space becomes many to one (many Y-space vectors may be matched to one X-space vector). It can be shown in this case ($\lambda \rightarrow 0$) that the association probabilities may be determined from a search for the nearest X-space vector in terms of the distortion metric $d(\vec{y}_q, \vec{x}_n)$, in what is referred to algorithmically herein as a "matching step."

Given the associations determined either by an association step or a matching step, the transform function can be defined and its optimal parameters determined by solving a minimization of D' with respect to the defined form of F(•). This determination of $F(\vec{x})$ is referred to algorithmically herein as a "minimization step."

The purpose of the transform is to compensate for speaker differences between, in this example, speakers X and Y. More specifically, cross-speaker variability can be captured by a linear transform of the form $\vec{\mu}_k + \Sigma_k \vec{x}_n$, where $\vec{\mu}_k$ is a bias vector, and $\Sigma_k$ is linear transformation matrix of the k-th class. The linear transform matrix can compensate for differences in the vocal tract that are related to vocal tract shape and size. Accordingly, $F(\vec{x})$ may be defined as a mixture-of-linear-regressions function defined as:

$$F(\vec{x}_n)\Sigma_{k=1}^{K} p(k|\vec{x}_n)[\vec{\mu}_k + \Sigma_k \vec{x}_n], \quad [4]$$

where $p(k|\vec{x}_n)$ is the probability that $\vec{x}_n$ belongs to the k-th class.

Assuming a class of probabilities $p(k|\vec{x}_n)$ corresponding to a Gaussian mixture model (GMM), and reformulating $\Sigma_k \vec{x}_n$ using the vector operator vec{•} and the Kronecker delta product to define $\vec{\sigma}_k \equiv \mathrm{vec}\{\Sigma_k\}$, it can be shown that $F(\vec{x})$ may be expressed as:

$$F(\vec{x}_n) = [\Delta_n \ B_n]\begin{bmatrix}\vec{\mu} \\ \vec{\sigma}\end{bmatrix} = \Gamma_n \vec{\gamma}, \quad [5]$$

where $$\Delta_n = [p(k=1|\vec{x}_n)I \ p(k=2|\vec{x}_n)I \ldots p(k=K|\vec{x}_n)I], \quad [6]$$

$$\vec{\mu} = [\vec{\mu}_1^T \ \vec{\mu}_2^T \ldots \vec{\mu}_K^T]^T, \quad [7]$$

$$B_n = [p(k=1|\vec{x}_n)X_n \ p(k=2|\vec{x}_n)X_n \ldots p(k=K|\vec{x}_n)X_n], \quad [8]$$

$$\vec{\sigma} = [\vec{\sigma}'^T_1 \ \vec{\sigma}'^T_2 \ldots \vec{\sigma}'^T_K]^T. \quad [9]$$

In the above expressions, I is the identity matrix (appropriately dimensioned), $\vec{\sigma}_k' \equiv \mathrm{vec}\{\Sigma_k'\}$ contains only the free parameters of the structured matrix $\Sigma_k$, and $\Sigma_k \vec{x}_n = X_n \vec{\sigma}_k'$. The optimal $\vec{\gamma}$ can then be obtained by partial differentiation, setting $$\frac{\partial D'}{\partial \vec{\gamma}} = 0.$$

Doing so yields the following unique solution:

$$\vec{\gamma} = -(\Sigma_q p(\vec{y}_q)\Sigma_n p(\vec{x}_n|\vec{y}_q)\Gamma_n^T W_q \Gamma_n)^{-1}(\Sigma_q p(\vec{y}_q)\Sigma_n p(\vec{x}_n|\vec{y}_q)\Gamma_n^T W_q \vec{y}_q). \quad [10]$$

Based on the discussion above, two algorithms may be used to obtain matching under transform. The first is referred to herein as "association-minimization," and the second is referred to herein as "matching-minimization." In accordance with example embodiments, association-minimization may be implemented with the following steps:

1. Initialization.
2. Set $\lambda$ to high value (e.g., $\lambda=1$).
3. Association step.
4. Minimization step.
5. Repeat from step 3 until convergence.
6. Lower $\lambda$ according to a cooling schedule and repeat from step 3, until $\lambda$ approaches zero or other target value.

Initialization sets a starting point for MUT optimization, and may differ depending on the speech features used. For conversion of mel-cepstral coefficient (MCEP) parameters, a search for a good vocal-tract length normalization transform with a single linear frequency warping factor may suffice. Empirical evidence suggests that an adequate initialization transform is one that minimizes the distortion in an interval [0.7, 1.3] of frequency warping factor. The association step uses the Gibbs distribution function for the association probabilities, as described above. The minimization step then incorporates the transformation function. Steps 5 and 6 iterate for convergence and cooling.

In further accordance with example embodiments, matching-minimization may be implemented with the following steps:

1. Initialization.
2. Matching step.
3. Minimization step.
4. Repeat from step 2 until convergence.

Initialization is the same as that for association-minimization, starting with a transform that minimizes the distortion in an interval of values of [0.7, 1.3] in frequency warping factor. The matching step uses association probabilities determined from a search for the nearest X-space vector, as described above. The minimization step then incorporates the transformation function. Step 5 iterates for convergence. Note that there is no cooling step, since matching-minimization assumes $\lambda=0$.

While MUT as described is used to replace each source vector of the Y-space (e.g., each colloquial-speaker vector of a given colloquial training database) with an optimally-matched target vector of the X-space (e.g., a reference-speaker vector of the reference training database), in practice, the matching can be performed by considering vectors in contexts of temporally earlier and later vectors. For example, a context $\vec{y}_{q-2}\vec{y}_{q-1}\vec{y}_q\vec{y}_{q+1}\vec{y}_{q+2}$ can be matched against a context $\vec{x}_{n-2}\vec{x}_{n-1}\vec{x}_n\vec{x}_{n+1}\vec{x}_{n+2}$ to obtain the best match of $\vec{x}_n$ to $\vec{y}_q$. Matching in context in this way can help further improve the accuracy of the matching.

In accordance with example embodiments, applying MUT to replacement of each colloquial-speaker vector of a given colloquial training database with a reference-speaker vector of the reference training database can be described as entailing the following algorithmic steps:

1. Let X-space vectors $\vec{x}_n$ correspond to extracted features of utterances of a reference speaker.
2. Let Y-space vectors $\vec{y}_q$ correspond to extracted features of utterances of a colloquial speaker.
3. Apply matching-minimization to determine a parametric transform that maps $\vec{y}_q$ to $F(\vec{x}_n)$ and a non-parametric mapping n=g(q) that matches $\vec{y}_q$ to $\vec{x}_n$.
4. Replace the frame $\vec{y}_q$ with $\vec{x}_n$.

CONCLUSION

An illustrative embodiment has been described by way of example herein. Those skilled in the art will understand, however, that changes and modifications may be made to this embodiment without departing from the true scope and spirit of the elements, products, and methods to which the embodiment is directed, which is defined by the claims.

What is claimed is:

1. A method comprising:

extracting speech features from a plurality of recorded reference speech utterances of a reference speaker to generate a reference set of reference-speaker vectors;

for each respective plurality of recorded colloquial speech utterances of a respective colloquial speaker of multiple colloquial speakers, extracting speech features from the recorded colloquial speech utterances of the respective colloquial speaker to generate a respective set of colloquial-speaker vectors;

for each respective set of colloquial-speaker vectors, replacing each colloquial-speaker vector of the respective set of colloquial-speaker vectors with a respective, optimally-matched reference-speaker vector from among the reference set of reference-speaker vectors, the respective, optimally-matched reference-speaker vector being identified by matching under a transform that compensates for differences in speech between the reference speaker and the respective colloquial speaker;

aggregating the replaced colloquial-speaker vectors of all the respective sets of colloquial-speaker vectors into an aggregate set of conditioned speaker vectors;

providing the aggregate set of conditioned speaker vectors to a text-to-speech (TTS) system implemented on one or more computing devices; and training the TTS system using the provided aggregate set of conditioned speaker vectors.

2. The method of claim 1, wherein each given colloquial-speaker vector of each respective set of colloquial-speaker vectors has an associated enriched transcription derived from a respective text string associated with a particular recorded colloquial speech utterance from which the given colloquial-speaker vector was extracted, and wherein replacing each colloquial-speaker vector of the respective set of colloquial-speaker vectors with the respective, optimally-matched reference-speaker vector comprises:

for each given colloquial-speaker vector of the respective set of colloquial-speaker vectors that is replaced, retaining its associated enriched transcription.

3. The method of claim 2, wherein aggregating the replaced colloquial-speaker vectors of all the respective sets of colloquial-speaker vectors into the aggregate set of conditioned speaker vectors comprises constructing a TTS system speech corpus that includes the replaced colloquial-speaker vectors of all the respective sets of colloquial-speaker vectors and the retained enriched transcriptions associated with each given colloquial-speaker vector that was replaced.

4. The method of claim 1, wherein, for each respective set of colloquial-speaker vectors, replacing each colloquial-speaker vector of the respective set of colloquial-speaker vectors with the respective, optimally-matched reference-speaker vector from among the reference set of reference-speaker vectors comprises:

individually matching all of the colloquial-speaker vectors of each respective set with their respective, optimally-matched reference-speaker vectors, one respective set at a time.

5. The method of claim 1, wherein extracting speech features from the plurality of recorded reference speech utterances of the reference speaker comprises decomposing the recorded reference speech utterances of the reference speaker into reference temporal frames of parameterized reference speech units, each reference temporal frame corresponding to a respective reference-speaker vector of speech features that include at least one of spectral envelope parameters, aperiodicity envelope parameters, fundamental frequencies, or voicing, of a respective reference speech unit, and wherein extracting speech features from the recorded colloquial speech utterances of the respective colloquial speaker comprises decomposing the recorded colloquial speech utterances of the respective colloquial speaker into colloquial temporal frames of parameterized colloquial speech units, each colloquial temporal frame corresponding to a respective colloquial-speaker vector of speech features that include at least one of spectral envelope parameters, aperiodicity envelope parameters, fundamental frequencies, or voicing, of a respective colloquial speech unit.

6. The method of claim 5, wherein replacing each colloquial-speaker vector of the respective set of colloquial-speaker vectors with the respective, optimally-matched reference-speaker vector from among the reference set of reference-speaker vectors comprises:

for each respective colloquial-speaker vector, determining an optimal match between the speech features the respective colloquial-speaker vector and the speech features of a particular one of the reference-speaker vectors, the optimal match being determined under a transform that compensates for differences in speech between the reference speaker and the respective colloquial speaker; and for each respective colloquial-speaker vector, replacing the speech features of the respective colloquial-speaker vector with the speech features of the determined particular one of the reference-speaker vectors.

7. The method of claim 5, the spectral envelope parameters of each vector of reference speech features are Mel Cepstral coefficients, Line Spectral Pairs, Linear Predictive coefficients, or Mel-Generalized Cepstral Coefficients, and further include indicia of first and second time derivatives of the spectral envelope parameters, and wherein the spectral envelope parameters of each vector of colloquial speech features are Mel Cepstral coefficients, Line Spectral Pairs, Linear Predictive coefficients, or Mel-Generalized Cepstral Coefficients, and further include indicia of first and second time derivatives of the spectral envelope parameters.

8. The method of claim 5, wherein the reference speech units each correspond to one of a phoneme or a triphone, and wherein the colloquial speech units each correspond to one of a phoneme or a triphone.

9. The method of claim 1, wherein the recorded reference speech utterances of the reference speaker are in a reference language and the colloquial speech utterances of all the respective colloquial speakers are all in a colloquial language, and wherein the colloquial language is lexically related to the reference language.

10. The method of claim 9, wherein the colloquial language differs from the reference language.

11. The method of claim 9, wherein training the TTS system using the provided aggregate set of conditioned speaker vectors comprises training the TTS system to synthesize speech in the colloquial language and in a voice of the reference speaker.

12. A system comprising:

one or more processors;

memory; and machine-readable instructions stored in the memory, that upon execution by the one or more processors cause the system to carry out operations including:

extracting speech features from a plurality of recorded reference speech utterances of a reference speaker to generate a reference set of reference-speaker vectors, for each respective plurality of recorded colloquial speech utterances of a respective colloquial speaker of multiple colloquial speakers, extracting speech features from the recorded colloquial speech utterances of the respective colloquial speaker to generate a respective set of colloquial-speaker vectors, for each respective set of colloquial-speaker vectors, replacing each colloquial-speaker vector of the respective set of colloquial-speaker vectors with a respective, optimally-matched reference-speaker vector from among the reference set of reference-speaker vectors, wherein the respective, optimally-matched reference-speaker vector is identified by matching under a transform that compensates for differences in speech between the reference speaker and the respective colloquial speaker, aggregating the replaced colloquial-speaker vectors of all the respective sets of colloquial-speaker vectors into an aggregate set of conditioned speaker vectors, providing the aggregate set of conditioned speaker vectors to a text-to-speech (TTS) system, and training the TTS system using the provided aggregate set of conditioned speaker vectors.

13. The system of claim 12, wherein each given colloquial-speaker vector of each respective set of colloquial-speaker vectors has an associated enriched transcription derived from a respective text string associated with a particular recorded colloquial speech utterance from which the given colloquial-speaker vector was extracted, and wherein replacing each colloquial-speaker vector of the respective set of colloquial-speaker vectors with the respective, optimally-matched reference-speaker vector comprises:

for each given colloquial-speaker vector of the respective set of colloquial-speaker vectors that is replaced, retaining its associated enriched transcription.

14. The system of claim 13, wherein aggregating the replaced colloquial-speaker vectors of all the respective sets of colloquial-speaker vectors into the aggregate set of conditioned speaker vectors comprises constructing a TTS system speech corpus that includes the replaced colloquial-speaker vectors of all the respective sets of colloquial-speaker vectors and the retained enriched transcriptions associated with each given colloquial-speaker vector that was replaced.

15. The system of claim 12, wherein, for each respective set of colloquial-speaker vectors, replacing each colloquial-speaker vector of the respective set of colloquial-speaker vectors with the respective, optimally-matched reference-speaker vector from among the reference set of reference-speaker vectors comprises:

individually matching all of the colloquial-speaker vectors of each respective set with their respective, optimally-matched reference-speaker vectors, one respective set at a time.

16. The system of claim 12, wherein extracting speech features from the plurality of recorded reference speech utterances of the reference speaker comprises decomposing the recorded reference speech utterances of the reference speaker into reference temporal frames of parameterized reference speech units, wherein each reference temporal frame corresponds to a respective reference-speaker vector of speech features that include at least one of spectral envelope parameters, aperiodicity envelope parameters, fundamental frequencies, or voicing, of a respective reference speech unit, and wherein extracting speech features from the recorded colloquial speech utterances of the respective colloquial speaker comprises decomposing the recorded colloquial speech utterances of the respective colloquial speaker into colloquial temporal frames of parameterized colloquial speech units, wherein each colloquial temporal frame corresponds to a respective colloquial-speaker vector of speech features that include at least one of spectral envelope parameters, aperiodicity envelope parameters, fundamental frequencies, or voicing, of a respective colloquial speech unit.

17. The system of claim 16, wherein replacing each colloquial-speaker vector of the respective set of colloquial-speaker vectors with the respective, optimally-matched reference-speaker vector from among the reference set of reference-speaker vectors comprises:

for each respective colloquial-speaker vector, determining an optimal match between the speech features the respective colloquial-speaker vector and the speech features of a particular one of the reference-speaker vectors, wherein the optimal match is determined under a transform that compensates for differences in speech between the reference speaker and the respective colloquial speaker; and for each respective colloquial-speaker vector, replacing the speech features of the respective colloquial-speaker vector with the speech features of the determined particular one of the reference-speaker vectors.

18. The system of claim 16, the spectral envelope parameters of each vector of reference speech features are Mel Cepstral coefficients, Line Spectral Pairs, Linear Predictive coefficients, or Mel-Generalized Cepstral Coefficients, and further include indicia of first and second time derivatives of the spectral envelope parameters, and wherein the spectral envelope parameters of each vector of colloquial speech features are Mel Cepstral coefficients, Line Spectral Pairs, Linear Predictive coefficients, or Mel-Generalized Cepstral Coefficients, and further include indicia of first and second time derivatives of the spectral envelope parameters.

19. The system of claim 16, wherein the reference speech units each correspond to one of a phoneme or a triphone, and wherein the colloquial speech units each correspond to one of a phoneme or a triphone.

20. The system of claim 12, wherein the recorded reference speech utterances of the reference speaker are in a reference language and the colloquial speech utterances of all the respective colloquial speakers are all in a colloquial language, and wherein the colloquial language is lexically related to the reference language.

21. The system of claim 20, wherein the colloquial language differs from the reference language.

22. The system of claim 20, wherein training the TTS system using the provided aggregate set of conditioned speaker vectors comprises training the TTS system to synthesize speech in the colloquial language and in a voice of the reference speaker.

23. An article of manufacture including a non-transitory computer-readable storage medium having stored thereon program instructions that, upon execution by one or more processors of a system, cause the system to perform operations comprising:

extracting speech features from a plurality of recorded reference speech utterances of a reference speaker to generate a reference set of reference-speaker vectors;

for each respective plurality of recorded colloquial speech utterances of a respective colloquial speaker of multiple colloquial speakers, extracting speech features from the recorded colloquial speech utterances of the respective colloquial speaker to generate a respective set of colloquial-speaker vectors;

for each respective set of colloquial-speaker vectors, replacing each colloquial-speaker vector of the respective set of colloquial-speaker vectors with a respective, optimally-matched reference-speaker vector from among the reference set of reference-speaker vectors, wherein the respective, optimally-matched reference-speaker vector is identified by matching under a transform that compensates for differences in speech between the reference speaker and the respective colloquial speaker;

aggregating the replaced colloquial-speaker vectors of all the respective sets of colloquial-speaker vectors into an aggregate set of conditioned speaker vectors;

providing the aggregate set of conditioned speaker vectors to a text-to-speech (TTS) system implemented on one or more computing devices; and training the TTS system using the provided aggregate set of conditioned speaker vectors.

24. The article of manufacture of claim 23, wherein each given colloquial-speaker vector of each respective set of colloquial-speaker vectors has an associated enriched transcription derived from a respective text string associated with a particular recorded colloquial speech utterance from which the given colloquial-speaker vector was extracted, and wherein replacing each colloquial-speaker vector of the respective set of colloquial-speaker vectors with the respective, optimally-matched reference-speaker vector comprises:

for each given colloquial-speaker vector of the respective set of colloquial-speaker vectors that is replaced, retaining its associated enriched transcription.

25. The article of manufacture of claim 24, wherein aggregating the replaced colloquial-speaker vectors of all the respective sets of colloquial-speaker vectors into the aggregate set of conditioned speaker vectors comprises constructing a TTS system speech corpus that includes the replaced colloquial-speaker vectors of all the respective sets of colloquial-speaker vectors and the retained enriched transcriptions associated with each given colloquial-speaker vector that was replaced.

26. The article of manufacture of claim 23, wherein, for each respective set of colloquial-speaker vectors, replacing each colloquial-speaker vector of the respective set of colloquial-speaker vectors with the respective, optimally-matched reference-speaker vector from among the reference set of reference-speaker vectors comprises:

individually matching all of the colloquial-speaker vectors of each respective set with their respective, optimally-matched reference-speaker vectors, one respective set at a time.

27. The article of manufacture of claim 23, wherein extracting speech features from the plurality of recorded reference speech utterances of the reference speaker comprises decomposing the recorded reference speech utterances of the reference speaker into reference temporal frames of parameterized reference speech units, wherein each reference temporal frame corresponds to a respective reference-speaker vector of speech features that include at least one of spectral envelope parameters, aperiodicity envelope parameters, fundamental frequencies, or voicing, of a respective reference speech unit, and wherein extracting speech features from the recorded colloquial speech utterances of the respective colloquial speaker comprises decomposing the recorded colloquial speech utterances of the respective colloquial speaker into colloquial temporal frames of parameterized colloquial speech units, wherein each colloquial temporal frame corresponds to a respective colloquial-speaker vector of speech features that include at least one of spectral envelope parameters, aperiodicity envelope parameters, fundamental frequencies, or voicing, of a respective colloquial speech unit.

28. The article of manufacture of claim 27, wherein replacing each colloquial-speaker vector of the respective set of colloquial-speaker vectors with the respective, optimally-matched reference-speaker vector from among the reference set of reference-speaker vectors comprises:

for each respective colloquial-speaker vector, determining an optimal match between the speech features the respective colloquial-speaker vector and the speech features of a particular one of the reference-speaker vectors, wherein the optimal match is determined under a transform that compensates for differences in speech between the reference speaker and the respective colloquial speaker; and for each respective colloquial-speaker vector, replacing the speech features of the respective colloquial-speaker vector with the speech features of the determined particular one of the reference-speaker vectors.

29. The article of manufacture of claim 27, the spectral envelope parameters of each vector of reference speech features are Mel Cepstral coefficients, Line Spectral Pairs, Linear Predictive coefficients, or Mel-Generalized Cepstral Coefficients, and further include indicia of first and second time derivatives of the spectral envelope parameters, and wherein the spectral envelope parameters of each vector of colloquial speech features are Mel Cepstral coefficients, Line Spectral Pairs, Linear Predictive coefficients, or Mel-Generalized Cepstral Coefficients, and further include indicia of first and second time derivatives of the spectral envelope parameters.

30. The article of manufacture of claim 27, wherein the reference speech units each correspond to one of a phoneme or a triphone, and wherein the colloquial speech units each correspond to one of a phoneme or a triphone.

31. The article of manufacture of claim 23, wherein the recorded reference speech utterances of the reference speaker are in a reference language and the colloquial speech utterances of all the respective colloquial speakers are all in a colloquial language, and wherein the colloquial language is lexically related to the reference language.

32. The article of manufacture of claim 31, wherein the colloquial language differs from the reference language.

33. The article of manufacture of claim 31, wherein training the TTS system using the provided aggregate set of conditioned speaker vectors comprises training the TTS system to synthesize speech in the colloquial language and in a voice of the reference speaker.

* * * * *